US011465900B2

(12) United States Patent
Hogan et al.

(10) Patent No.: US 11,465,900 B2
(45) Date of Patent: Oct. 11, 2022

(54) METHODS AND SYSTEMS FOR COLORANT DISPENSER ALIGNMENT

(71) Applicant: Fluid Management, Inc., Wheeling, IL (US)

(72) Inventors: Tim Patrick Hogan, Bristol, WI (US); Jacek Pieczaba, Wheeling, IL (US)

(73) Assignee: Fluid Management, Inc., Wheeling, IL (US)

( * ) Notice: Subject to any disclaimer, the term of this patent is extended or adjusted under 35 U.S.C. 154(b) by 0 days.

(21) Appl. No.: 16/847,154

(22) Filed: Apr. 13, 2020

(65) Prior Publication Data

US 2020/0325013 A1 Oct. 15, 2020

Related U.S. Application Data

(60) Provisional application No. 62/832,931, filed on Apr. 12, 2019.

(51) Int. Cl.
*B67D 7/86* (2010.01)
*B01F 33/84* (2022.01)

(52) U.S. Cl.
CPC ..... *B67D 7/86* (2013.01); *B01F 33/84* (2022.01)

(58) Field of Classification Search
CPC ..... B67D 7/86; B01F 13/1055–1069; B01F 33/84–846; F41G 1/35
USPC ..... 362/119, 120
See application file for complete search history.

(56) References Cited

U.S. PATENT DOCUMENTS 3,203,593 A * 8/1965 James ..... B67D 7/227 222/30
4,946,070 A 8/1990 Albert et al.
5,156,297 A * 10/1992 Engler ..... B67D 1/0871 141/83
5,695,091 A 12/1997 Winings et al.
6,188,713 B1 * 2/2001 Ihara ..... H01S 3/09415 372/101
7,159,740 B2 1/2007 Nanthakumar et al.
7,550,725 B2 * 6/2009 Hollander ..... G01J 5/0044 250/338.1
8,006,502 B2 8/2011 Kim et al.
8,256,153 B1 * 9/2012 Noha ..... F41G 1/35 42/117
8,813,999 B2 8/2014 Cittadino
10,233,070 B2 3/2019 Comsa et al.
2007/0137726 A1 6/2007 Yan (Continued)

*Primary Examiner* — Andrew D StClair
(74) *Attorney, Agent, or Firm* — Tucker Ellis LLP; Heather M. Barnes; Michael G. Craig

(57) ABSTRACT

One or more techniques and/or systems are disclosed for a colorant dispensing system that has a colorant dispensing head and a platform for holding a target canister into which colorant is dispensed. A light array can be used produce a light pattern in an arc of a circle at a height of an opening of the target canister. The light pattern can be focused at the opening of the target canister, to help a user align the opening with the dispensing head. The dispensing head is configured to dispense colorant within the boundary of the circle, such that the light pattern can act as a type of target for dispensing colorant into the opening of the canister to avoid issues when tinting. A control unit can be used with an interface to control the light array to accommodate different sized and shaped canisters.

14 Claims, 20 Drawing Sheets

(56) References Cited

U.S. PATENT DOCUMENTS

| | | | | |
|---|---|---|---|---|
| 2009/0242075 | A1* | 10/2009 | Busick | A61L 2/10 141/85 |
| 2018/0220850 | A1 | 8/2018 | Yang et al. | |
| 2018/0334375 | A1 | 11/2018 | Rosenlund et al. | |
| 2019/0345018 | A1* | 11/2019 | Garcia | B67D 3/0025 |

* cited by examiner

METHODS AND SYSTEMS FOR COLORANT DISPENSER ALIGNMENT

This application claims priority to U.S. Ser. No. 62/832,931, entitled METHODS AND SYSTEMS FOR COLORANT DISPENSER ALIGNMENT, filed Apr. 12, 2019, which is incorporated herein by reference.

BACKGROUND

Dispenser canisters are used in retail paint tinting equipment to dispense colorant into a paint tinting process. Colorant is dispensed to provide a desired paint color by utilizing desired combinations of colorant. Often, the opening of a can of tint base is placed in alignment with a colorant dispenser head to receive the desired type and amount of colorant. The container opening into which colorant is dispensed should be properly aligned with the dispenser head to mitigate mistints and spills, due to dispensing colorant outside the opening.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

One or more techniques and systems are described herein for facilitating the dispensing of colorant more accurately into a tint base container during a paint tinting process. For example, a container with tint base can be used in a paint tinting process by placing the canister in the tint dispensing equipment, and dispensing colorant into tint base. The opening of the container of tint base can be aligned appropriately with a colorant dispenser head prior to dispensing. An alignment system can utilize an array of lights that provide a visual target for a user to appropriately align the opening with the dispenser head, such that the dispensed colorant falls into the container through the opening.

In one implementation, a colorant dispensing system includes a colorant dispensing head that operably dispenses a colorant. Further, a platform can be configured to operably hold a first canister into which the colorant is dispensed, where the platform disposed beneath the dispensing head. Additionally, a light array can be disposed above the platform, where the light array is operably projecting a first light pattern at a first height above the platform. In this implementation, the first light pattern can comprise at least an arc of a first circle, wherein the first circle substantially aligns with or inside an opening of the first canister. The first height above the platform can comprise a height of the opening of the first container when operably disposed on the platform.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1A:
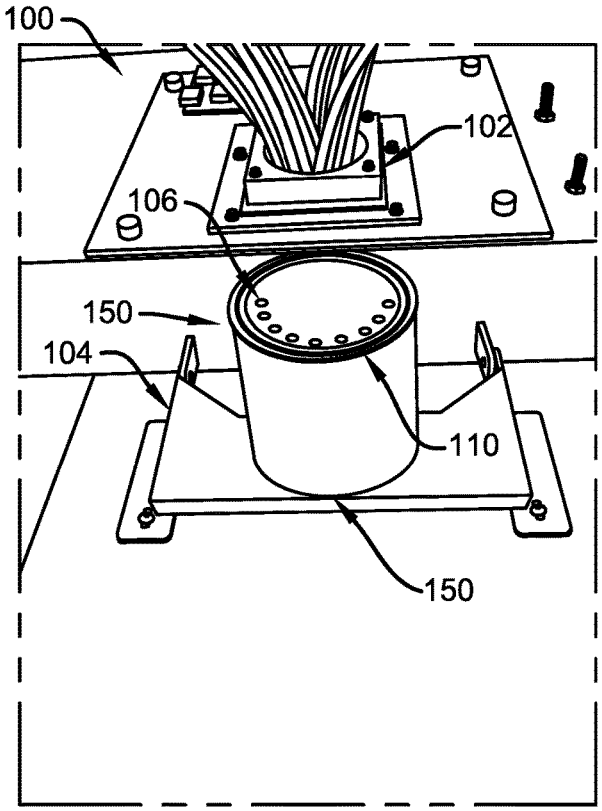
FIGS. 1A and 1B are component diagrams illustrating an example system for dispensing colorant.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details.

In one aspect, a system may be devised that facilitates appropriate use of a colorant tinting device. A light pattern can be projected to an opening of a canister, such as a tint base paint can or bucket, so that the opening can be visually aligned with the light pattern. The light pattern can be configured such that the dispensing head of the tinting device discharges colorant inside the light pattern. That is, for example, the light pattern may be a target for discharge of the colorant. In this way, in this example, when the light pattern is aligned appropriately with the opening the colorant will be discharged into the opening (e.g., thereby avoiding mistints). Using the circular light pattern to align with the circular opening of a canister provides for two concentric circles that are used to align, which can be very obvious to the observer when they are misaligned. For example, a bright circle of light focused around a circular opening, allows the operator to easily determine if alignment is achieved, and therefore move the container to the precise precision required. A circle of dots, is a practical way to approximate this circle of light, and provide similar benefits.

FIGS. 1-6 are component diagrams that illustrate exemplary implementations of a system for dispensing colorant. In one implementation, a colorant dispensing system 100, 200 comprises a colorant dispensing head 102, 202, 302, 502 that operably dispenses a colorant. That is, for example, a colorant dispensing head can be disposed in a colorant dispenser (e.g., automatic or manual) that produces color formulation for architectural coatings (e.g., paint), wood stains, stucco, and exterior insulation and finish systems (EIFS), and more. In this example, the dispensing head can dispense one or more colorants to add tint to a tint base to produce the resulting color formulation of the coating product.

Further, in this implementation, the colorant dispensing system 100, 200 comprises a platform 104, 204 that is configured to operably hold a first canister 150, 250 into which the colorant is dispensed. In this implementation, the platform 104, 204 is disposed beneath the dispensing head 102, 202, 302, 502. As an example, the platform 104, 204 can comprise any appropriate surface, clamping device, or otherwise holder that can hold a canister beneath the dispensing head 102 during operation of colorant dispensing. In the illustrated implementation of FIGS. 1A, 2A, and 2B, the platform 104, 204 can be a shelf, a base of a dispensing machine, or the like, where the surface is flat, or may have stops to operably facilitate alignment of the canister. Additionally, the platform 104, 204 may be fixed or can be operably adjustable in height or distance from the dispensing head 102, 202, 302, 502. That is, for example, the distance between the platform 104, 204 and dispensing head 102, 104 may be operably adjustable in order to accommodate different sized canisters. In this example, one or both of the platform 104, 204 and dispensing head 102, 202, 302, 502 may be adjustable to adjust the distance between them.

In this implementation, as illustrated in FIGS. 3, 4A, 4B, 5A, 5B, and 6, with continued reference to FIGS. 1-2, the colorant dispensing system 100, 200 comprises a light array 308, 508 disposed above the platform 104, 204. In this implementation, the light array 308, 508 is operably projecting a first light pattern 106, 306 at a first height above the platform 104, 204. In this implementation, the first light pattern 106, 306 comprises at least an arc of a first circle, where the first circle substantially aligns with or inside an opening of the first canister 150, 250. Further, the first height above the platform 104, 204 comprises a height of the opening 110, 210 of the first container 150, 250 when it is operably disposed on the platform 104, 204.

Figure 1B:
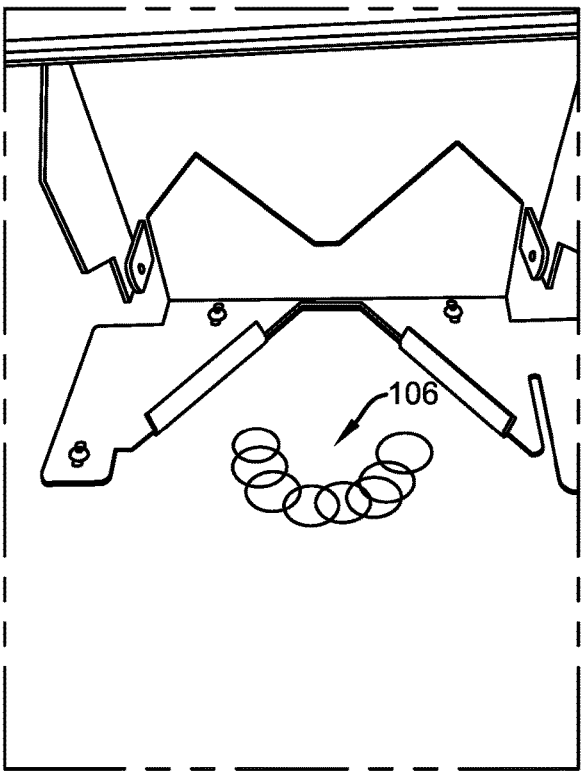

For example, the light array 308, 508 can be configured to project light(s) in a circle or arc of a circle that is substantially focused at a desired height. In this example, the desired height can comprise the approximate height of the opening of a canister 150, 250 into which the colorant is being dispensed by the dispensing head 102, 202, 302, 502. As an illustrative example, as shown in FIGS. 1A and 1B, the appropriate height of focus may be illustrated in FIG. 1A where the individual dots of light of the light pattern 106 are substantially in focus at the height of the opening 110 canister 150. In contrast, in this example, in FIG. 1B, the individual dots of light in the light pattern 106, which are projected well below the desired height, appear out of focus and not well defined.

Further, for example, the light pattern 106, 206, 306 can comprise an arc of a circle, or a full circle. In this example, the produced light can form an arc that is a portion of a circle that aligns with the opening of the canister, or fits inside the opening of the canister. As illustrated in FIG. 1A, the first light pattern 106 comprises a plurality of lighted dots that form an arc of a circle that substantially aligns with the opening 110 of the first canister 150. As another example, in FIG. 2B, the light pattern 206 comprises a circle of lighted dots that lie inside the opening 210 of the example canister 250. In some implementations, the light pattern 106, 206, 306 can be indicative of a target, inside which the colorant is dispensed by the dispensing head 102, 202, 302, 502. That is, for example, if the light pattern 106, 206, 306 (e.g., first light pattern 106) is appropriately aligned with or inside the opening 110, 210 of the canister 150, 250, the colorant will be appropriately dispensed into the opening (e.g., and not outside the opening).

Figure 2A:
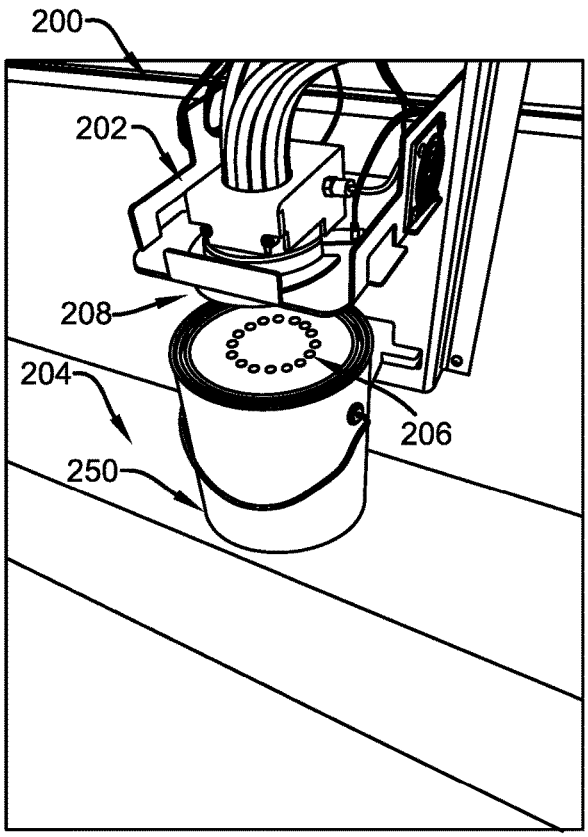
FIGS. 2A and 2B are component diagrams illustrating another example system for dispensing colorant.
Figure 2B:
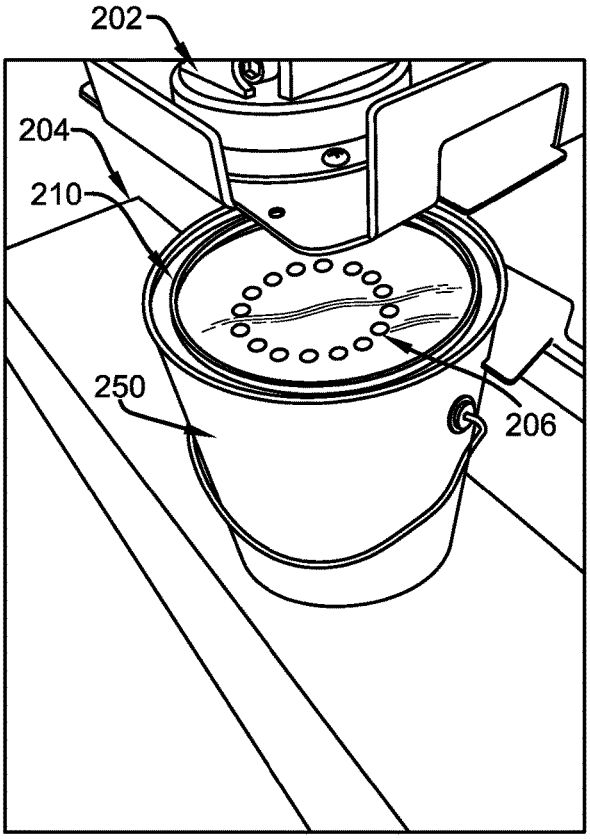
Figure 3:
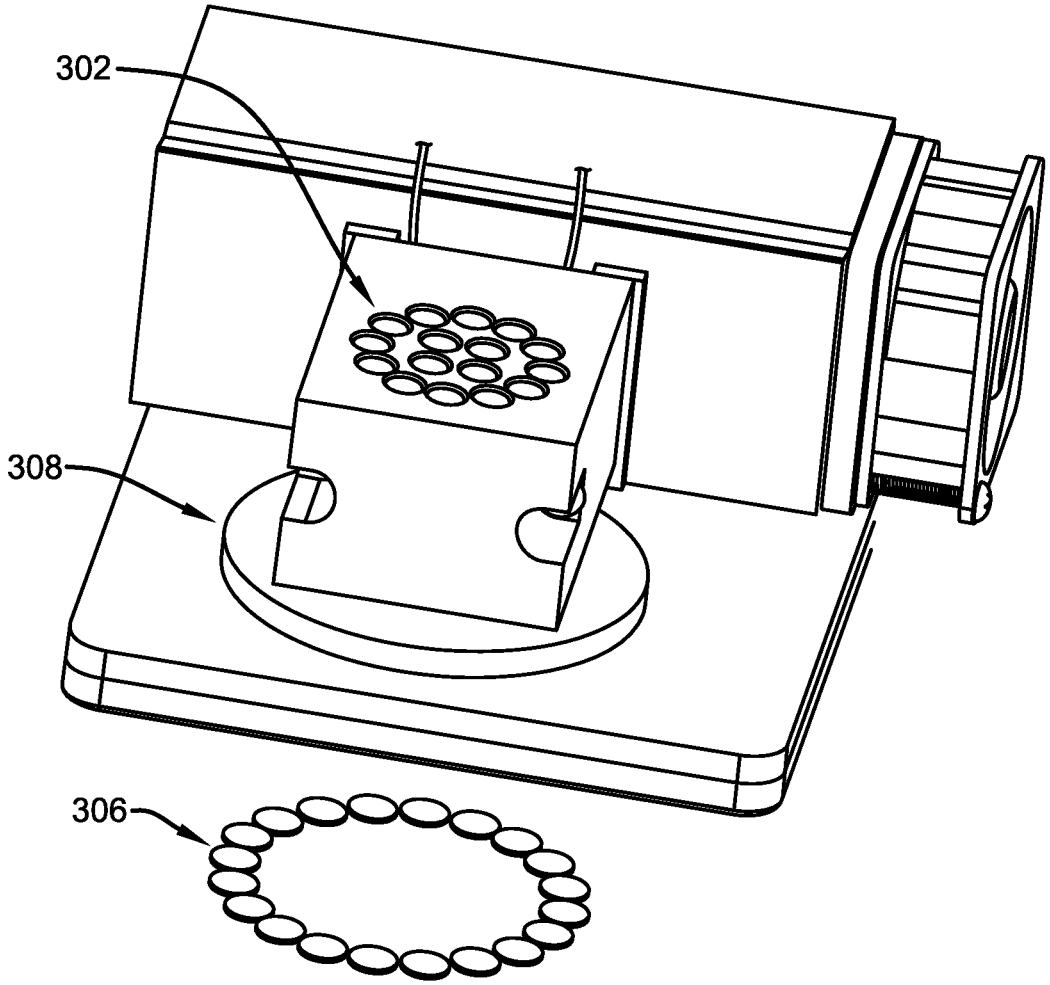
FIG. 3 is a component diagram illustrating one implementation of one or more portions of one or more systems described herein.
Figure 4A:
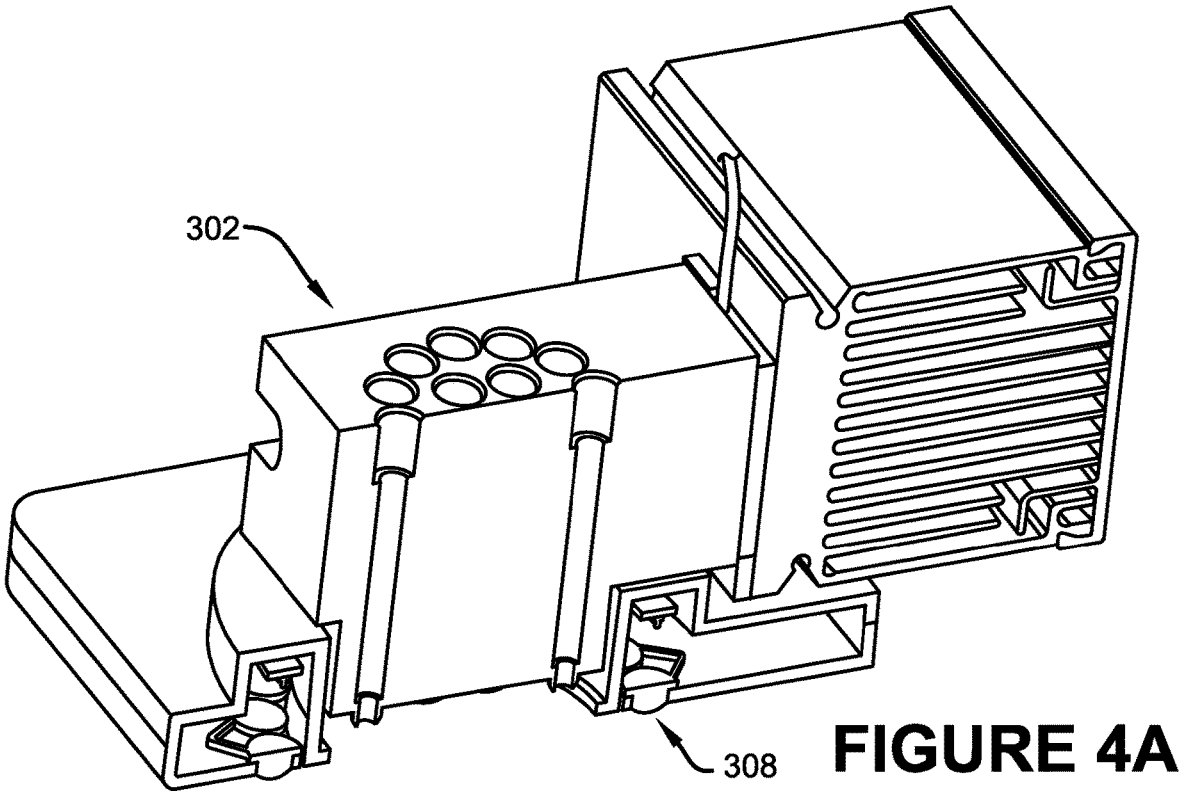
FIGS. 4A and 4B are component diagrams illustrating one implementation of one or more portions of one or more systems described herein.
Figure 4B:
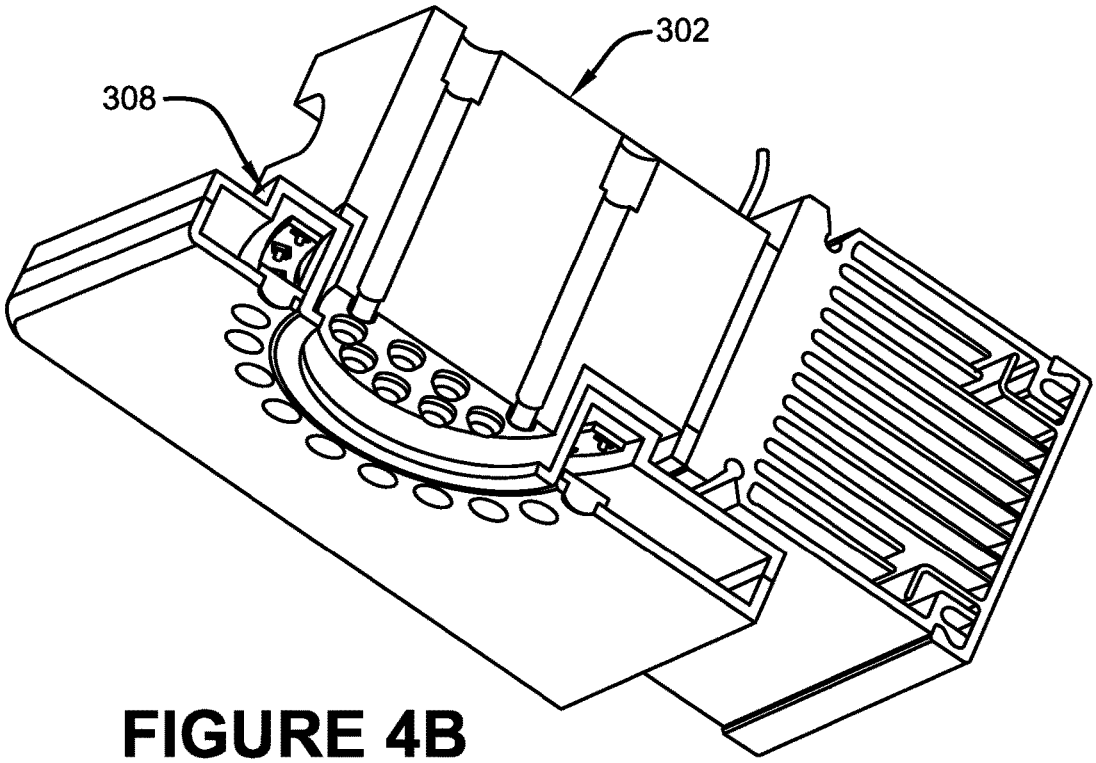
Figure 5A:
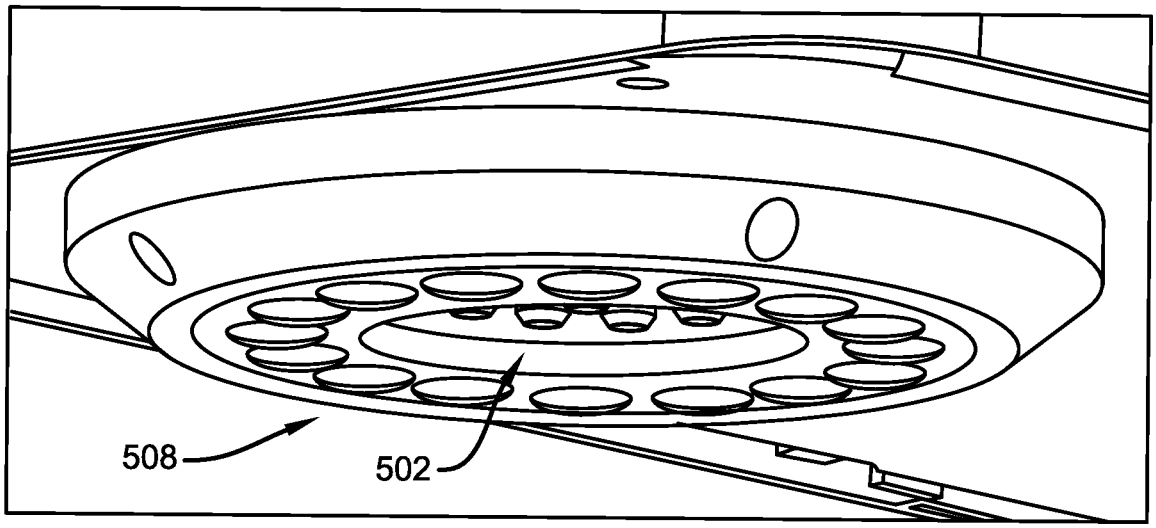
FIGS. 5A and 5B are component diagrams illustrating one implementation of one or more portions of one or more systems described herein.
Figure 5B:
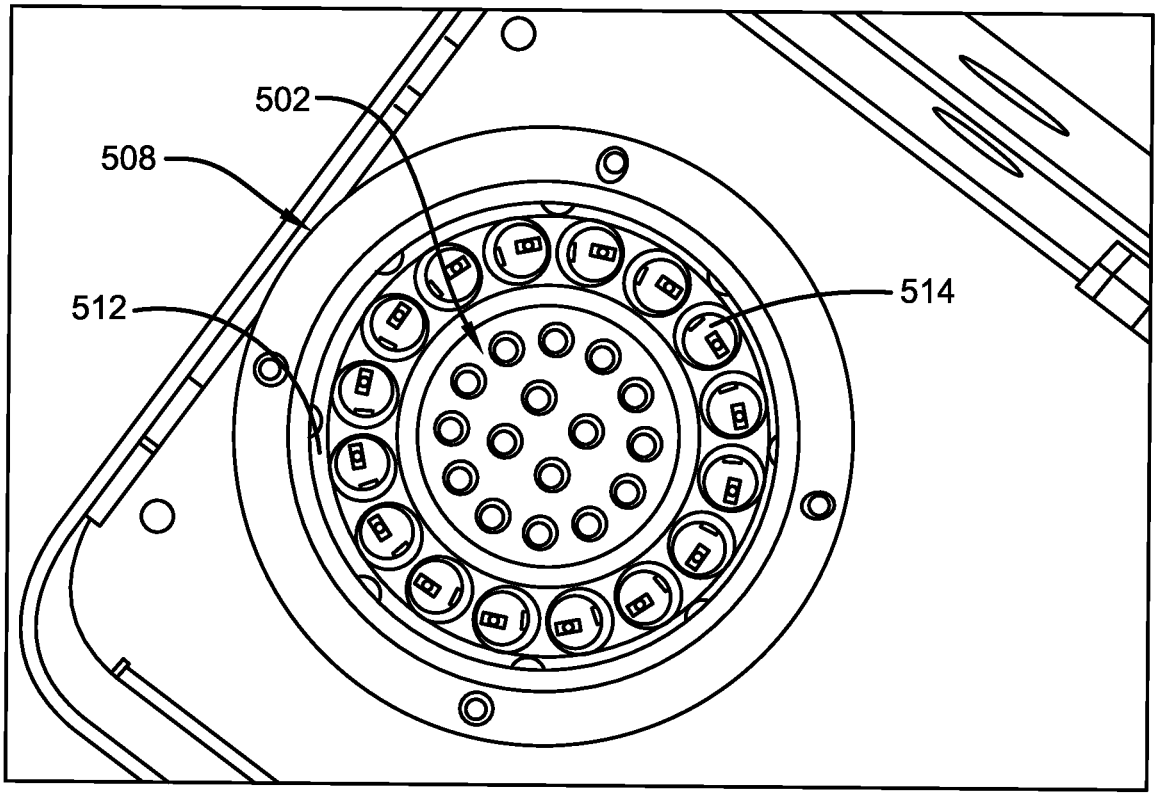
Figure 6:
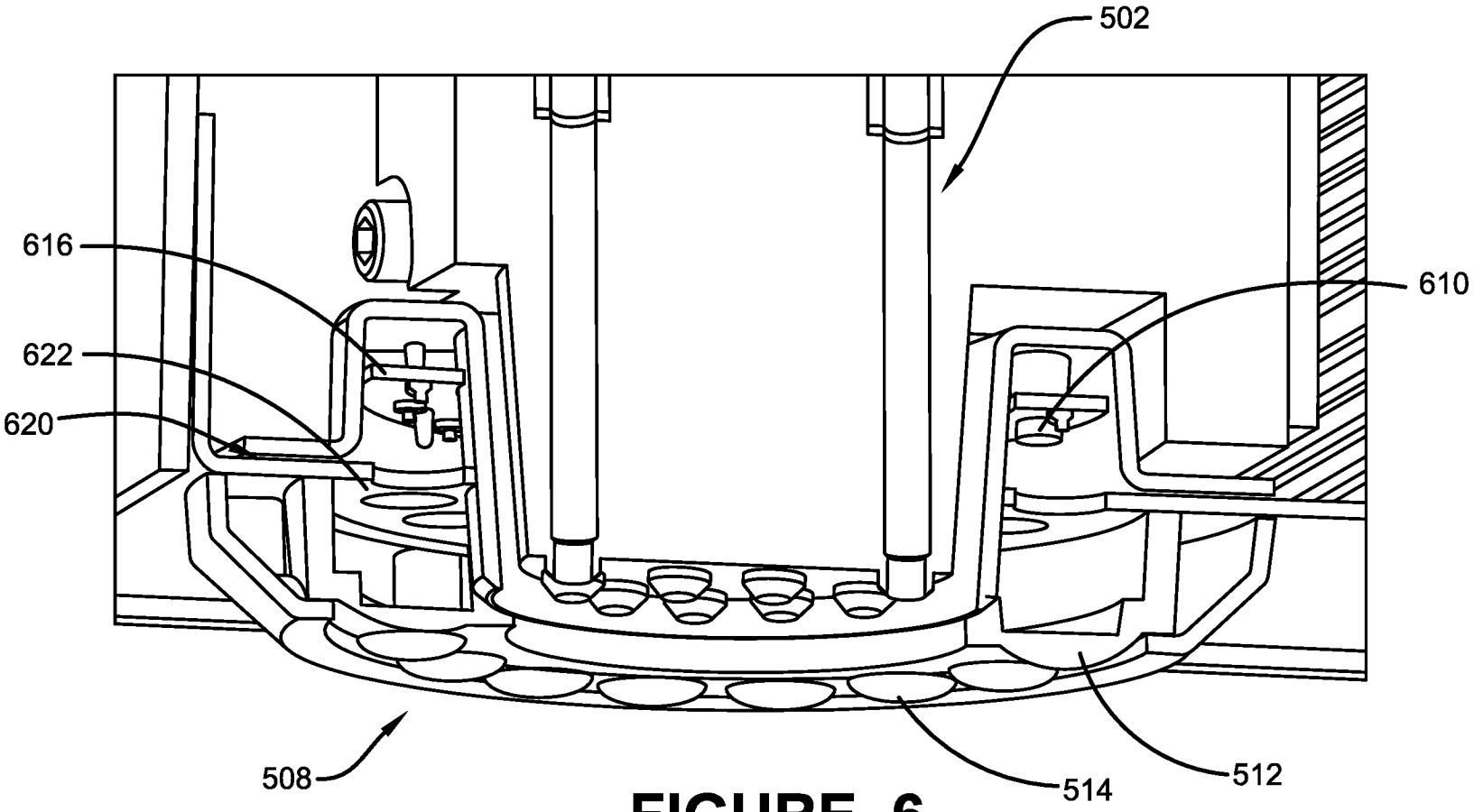
FIG. 6 is a component diagram illustrating one implementation of one or more portions of one or more systems described herein.
Figure 7A:
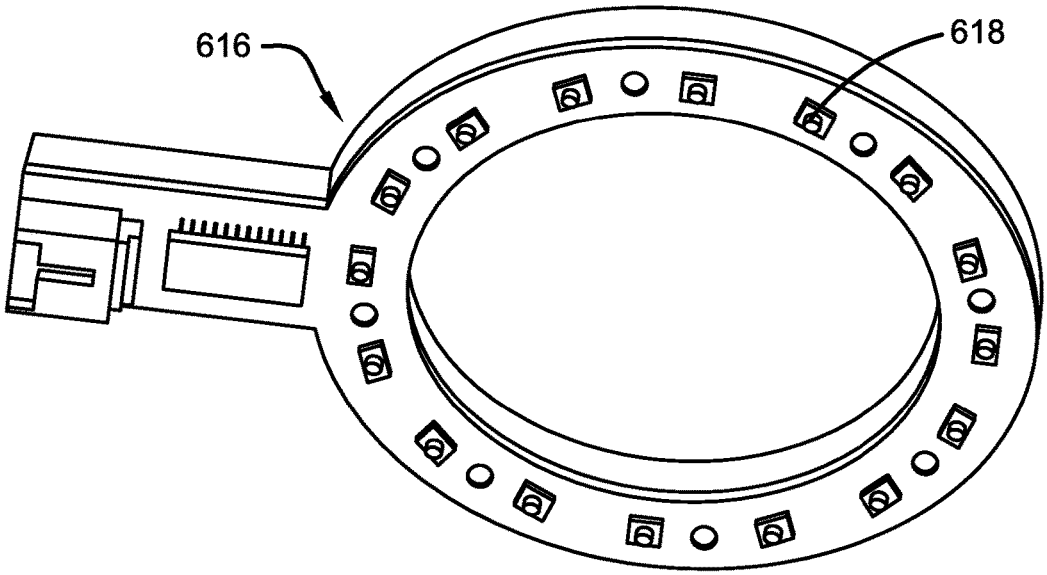
FIGS. 7A and 7B are component diagrams illustrating one implementation of one or more portions of one or more systems described herein.
Figure 7B:
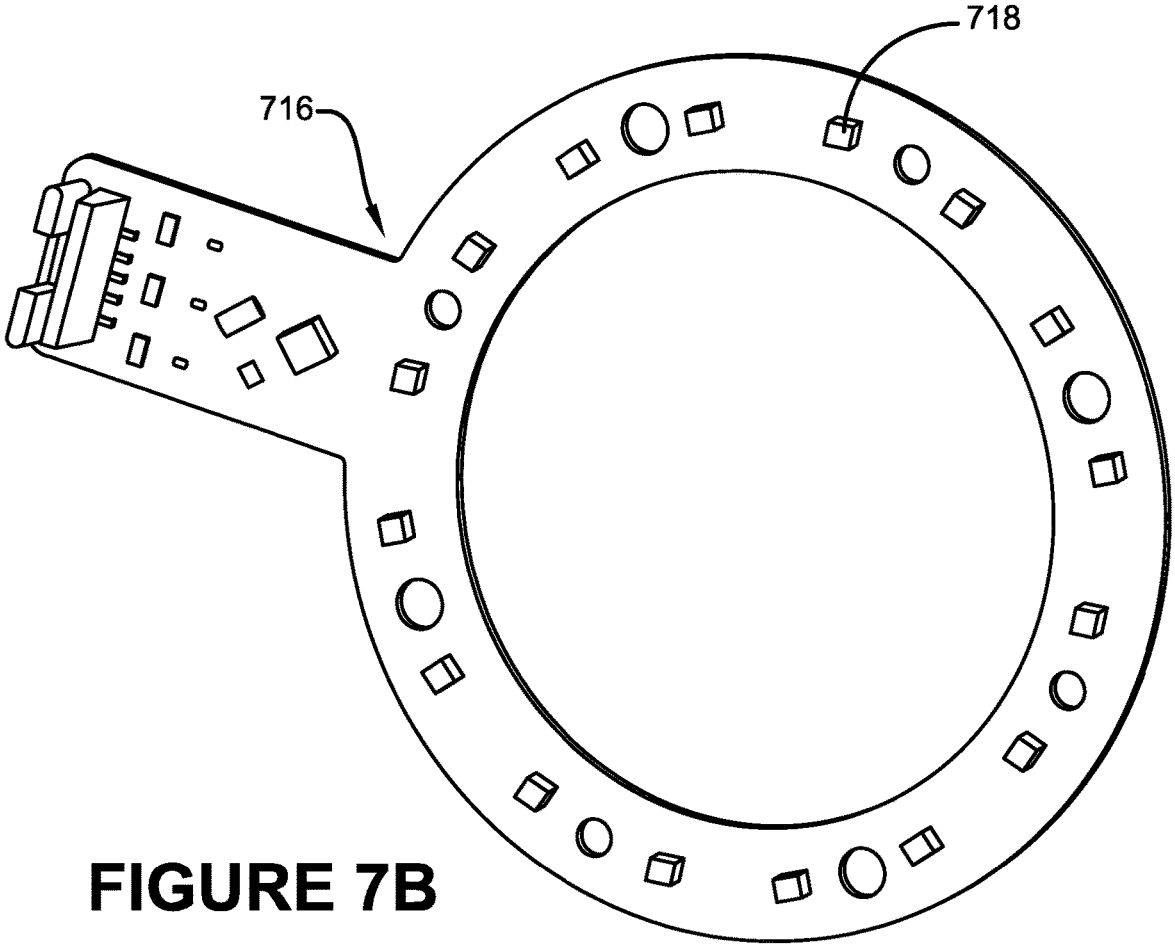
Figure 8:
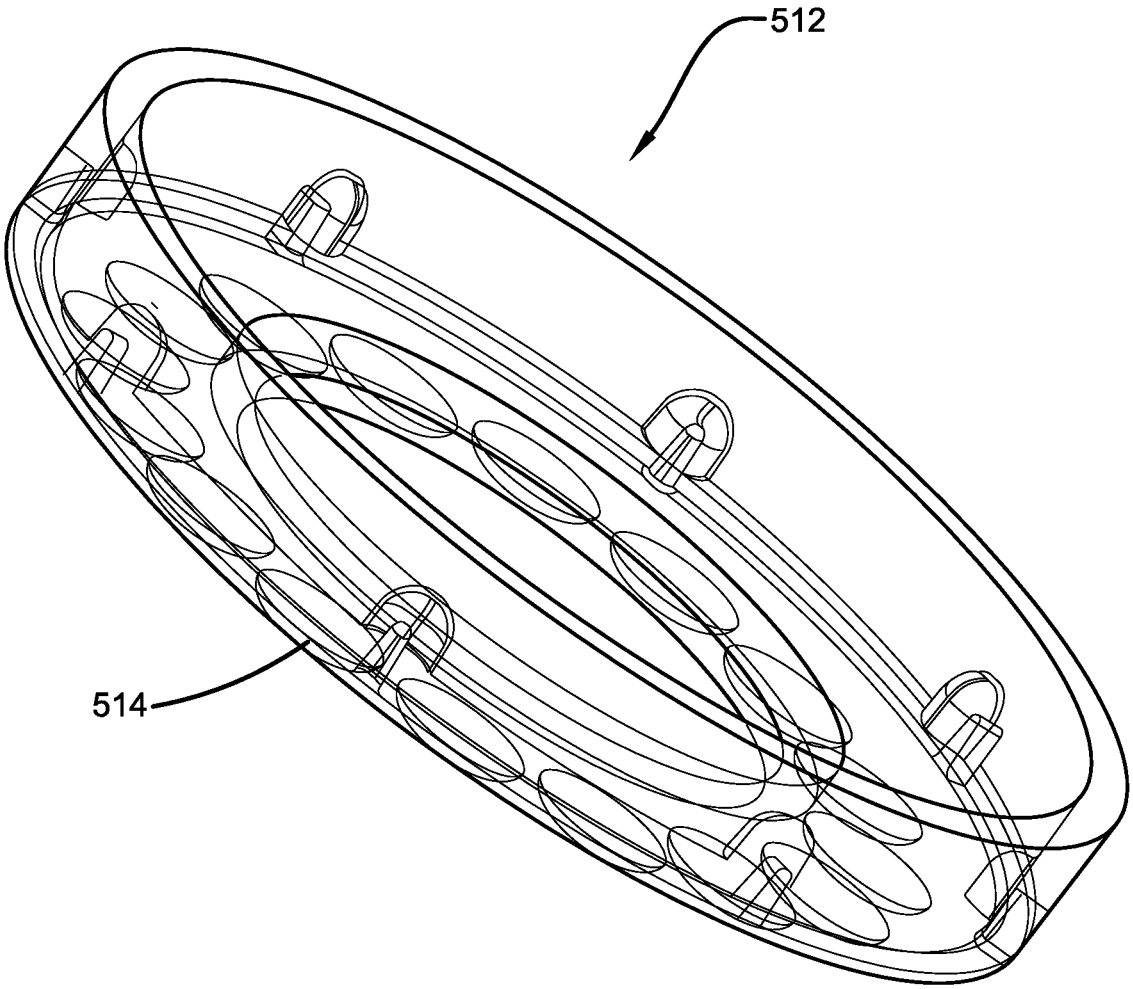
FIG. 8 is a component diagram illustrating one implementation of one or more portions of one or more systems described herein.
Figure 9A:
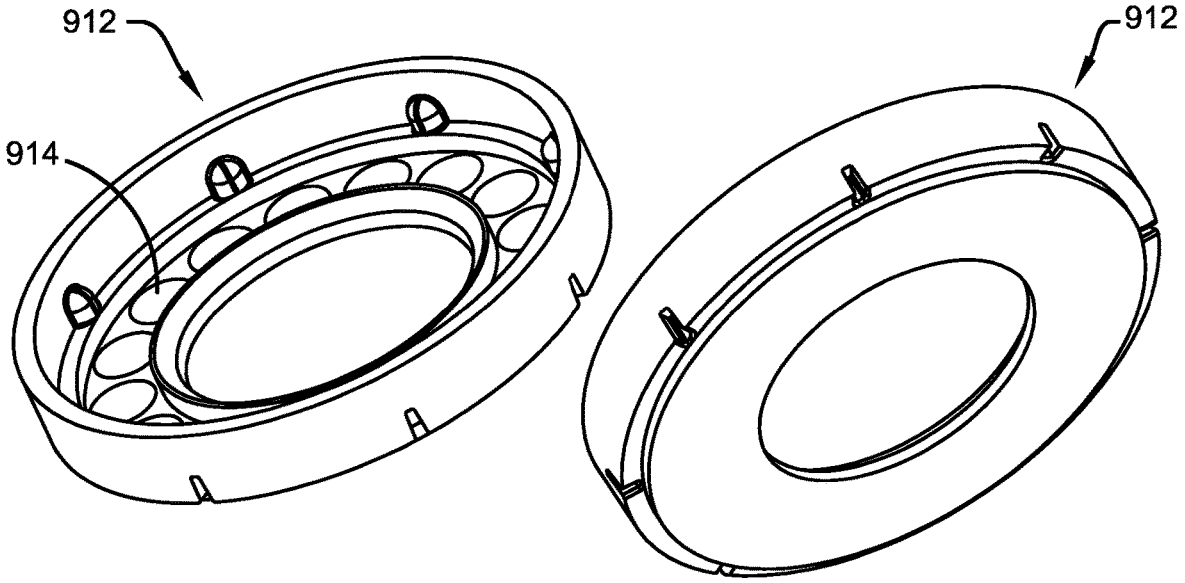
FIGS. 9A and 9B are component diagrams illustrating one implementation of one or more portions of one or more systems described herein.
Figure 9B:
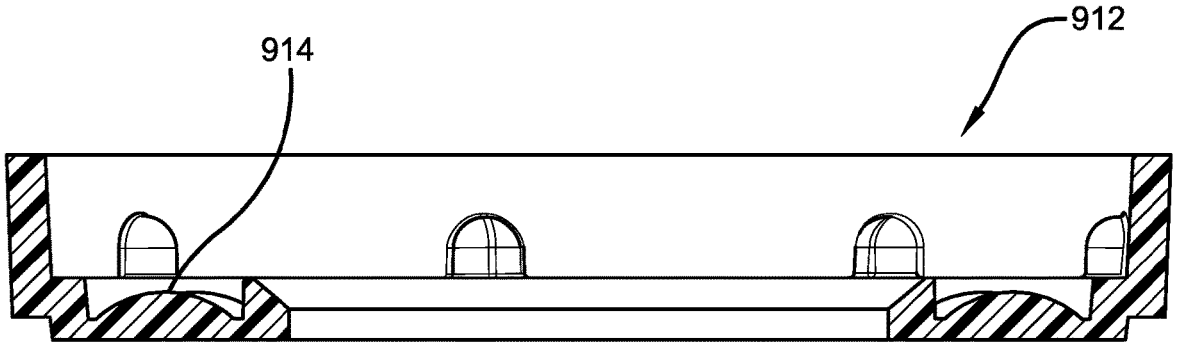
Figure 10A:
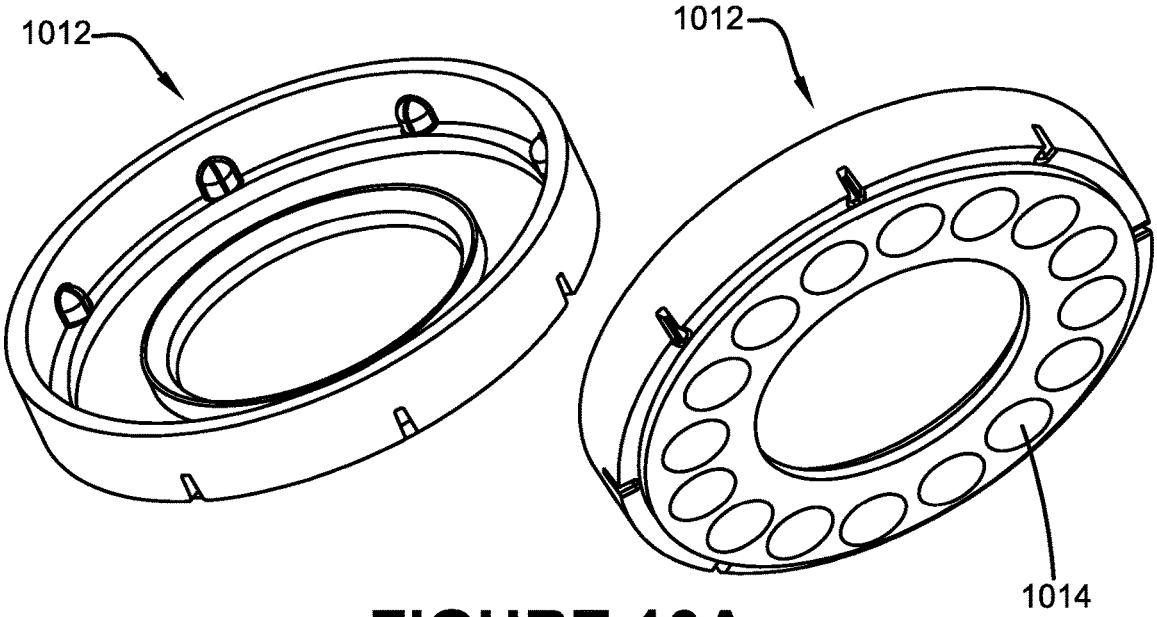
FIGS. 10A and 10B are component diagrams illustrating one implementation of one or more portions of one or more systems described herein.
Figure 10B:
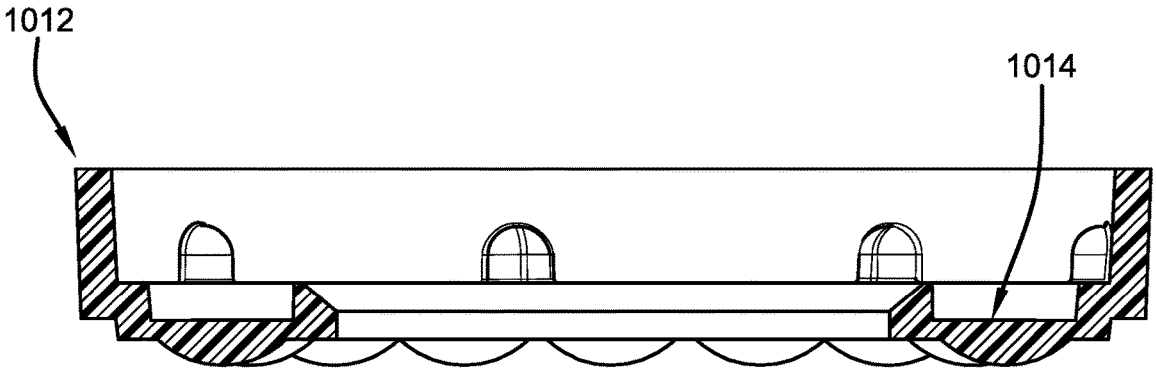
Figure 11A:
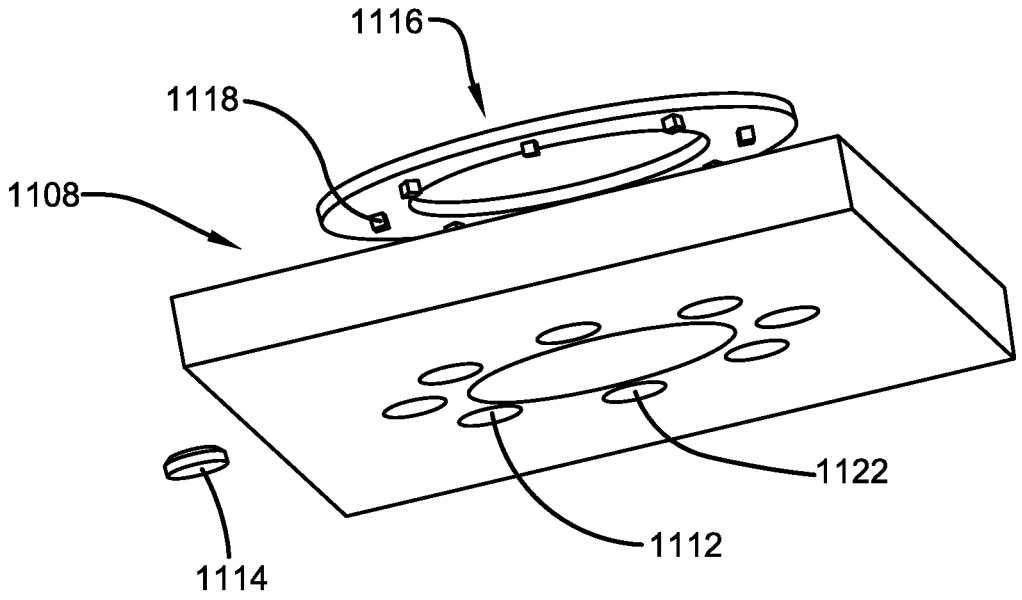
FIGS. 11A and 11B are component diagrams illustrating one implementation of one or more portions of one or more systems described herein.
Figure 11B:
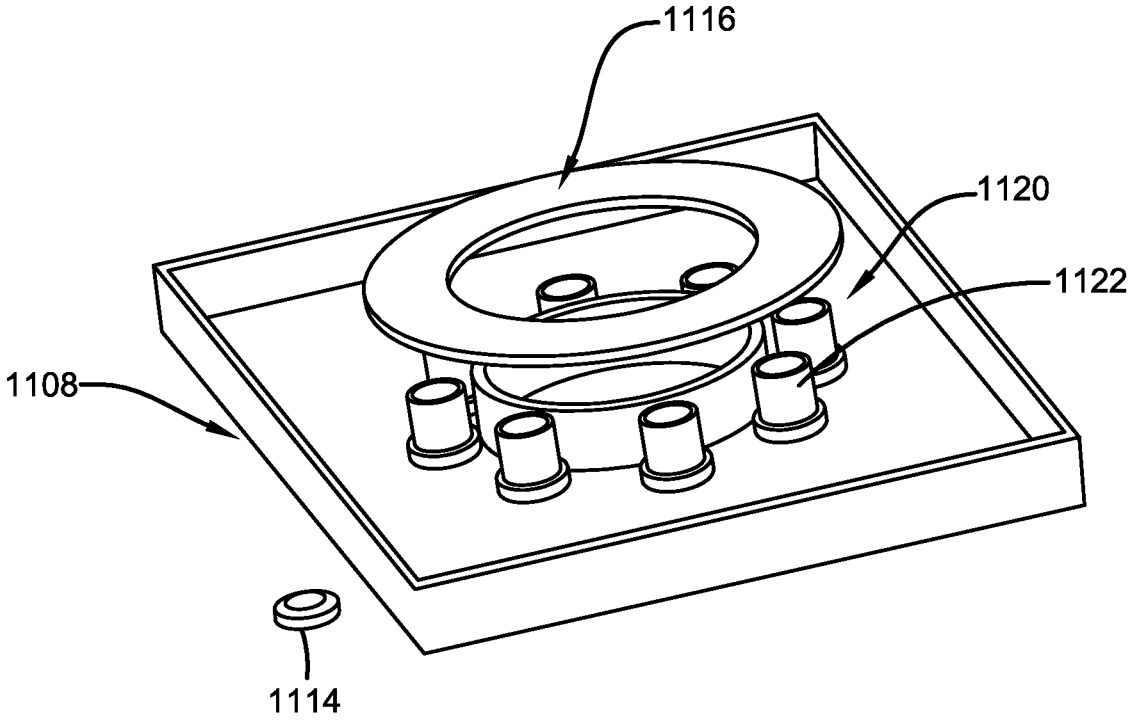
Figure 12:
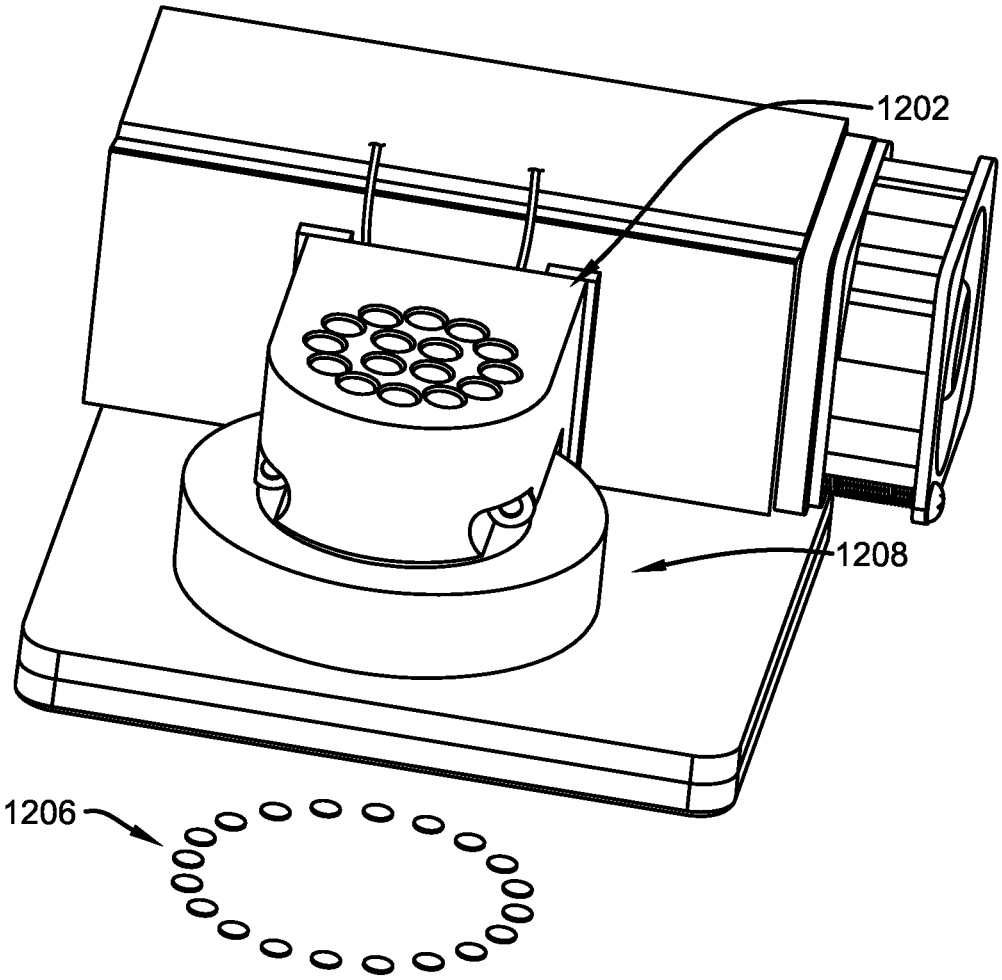
FIG. 12 is a component diagram illustrating one alternate implementation of one or more portions of one or more systems described herein.
Figure 13A:
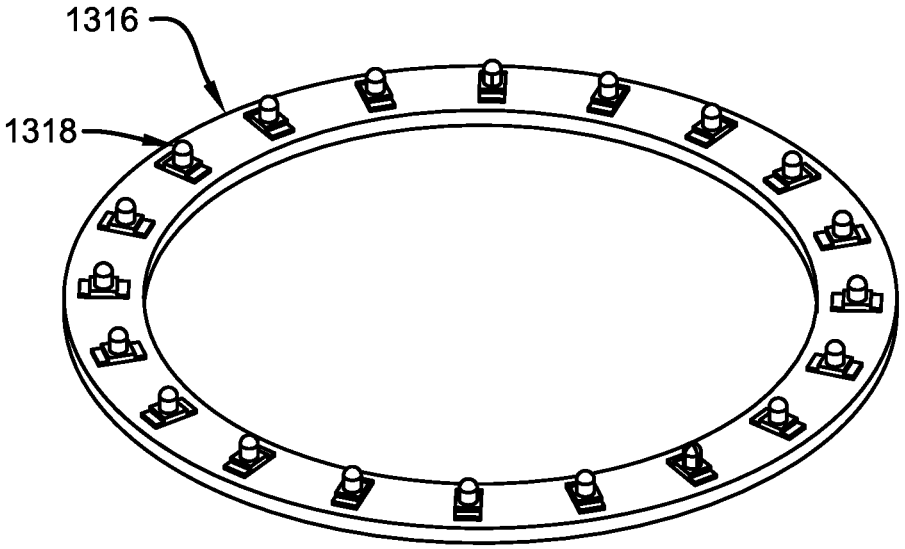
FIGS. 13A and 13B are component diagrams illustrating one alternate implementation of one or more portions of one or more systems described herein.
Figure 13B:
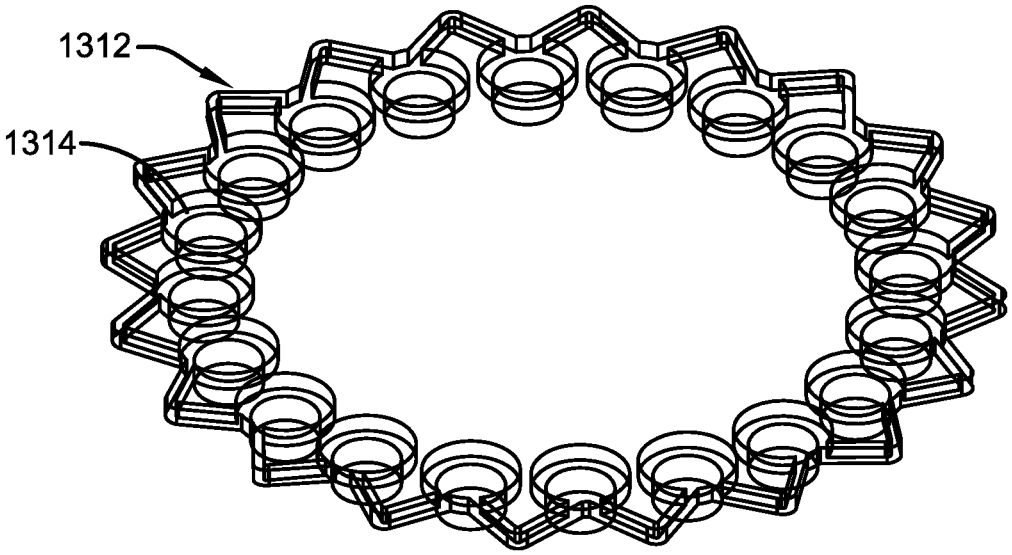
Figure 14A:
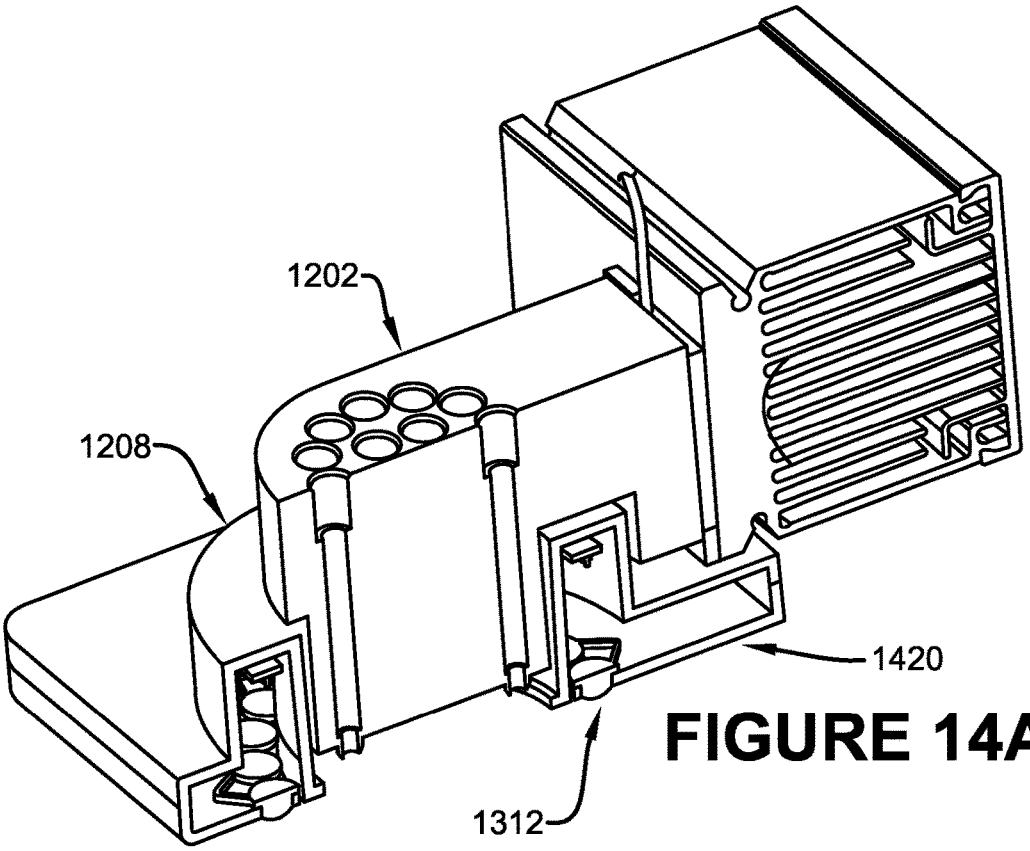
FIGS. 14A and 14B are component diagrams illustrating one alternate implementation of one or more portions of one or more systems described herein.
Figure 14B:
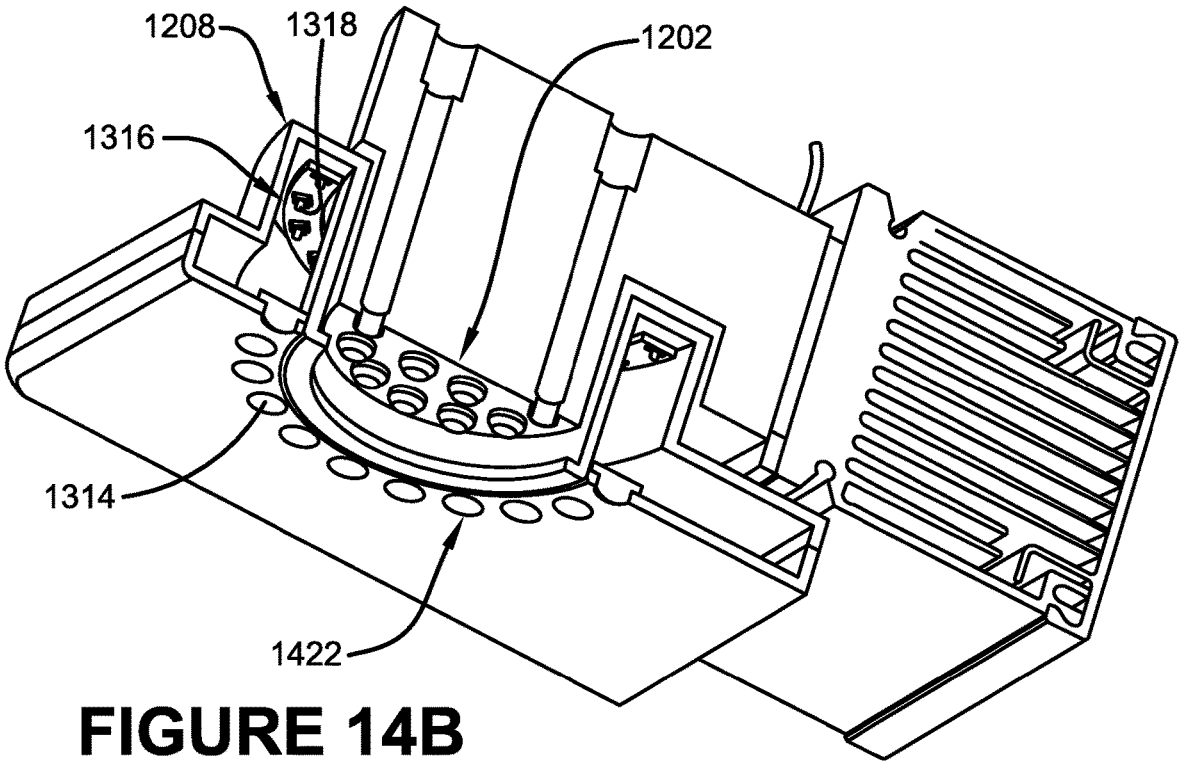
Figure 15A:
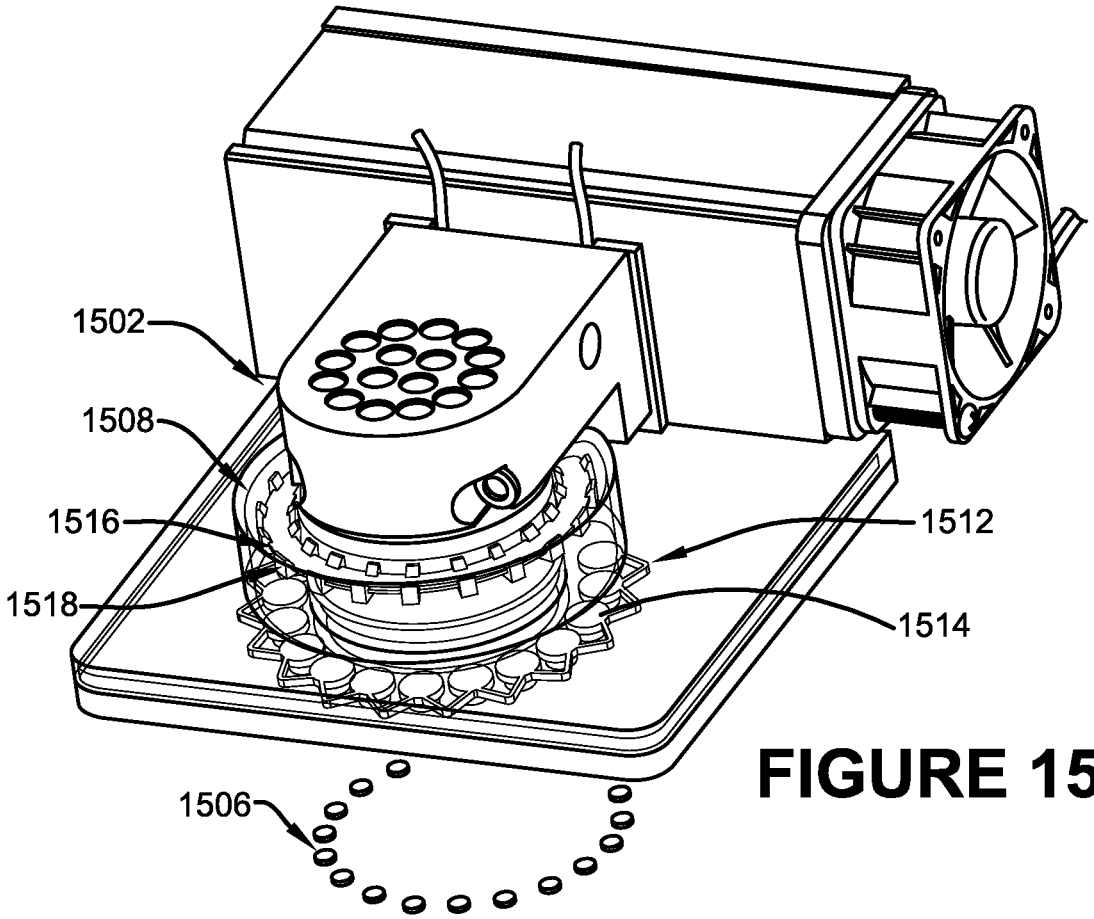
FIGS. 15A and 15B are component diagrams illustrating one alternate implementation of one or more portions of one or more systems described herein.
Figure 15B:
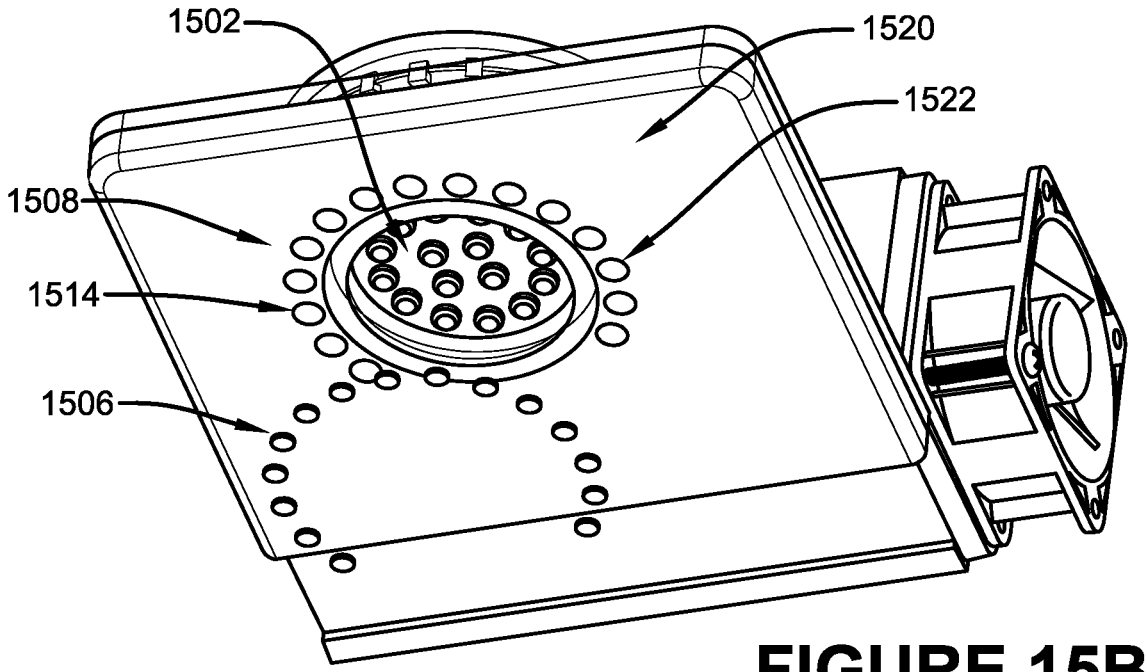
Figure 16:
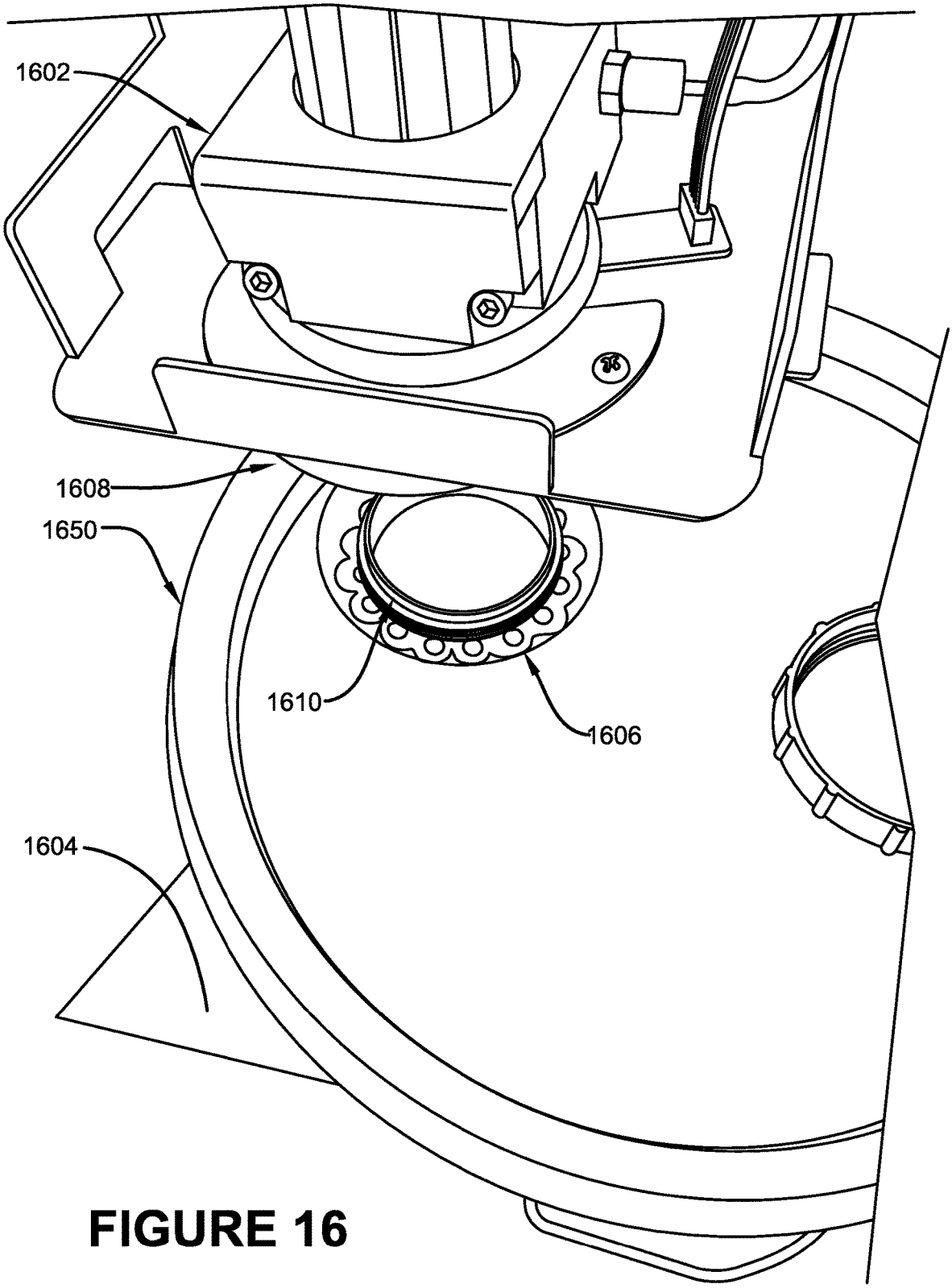
FIG. 16 is a component diagram illustrating another alternate implementation of one or more portions of one or more systems described herein.

In some implementations, as illustrated in FIGS. 2A, 2B, and 16, the light array 208, 1608 can be configured to operably project a second light pattern 206, 1606 at a second height above the platform 1604. In these implementations, the second light pattern 206, 1606 can comprise at least an arc of a second circle, where the second circle substantially aligns with an opening 1610 of a second canister 1650. Further, in these implementations, the second height above the platform 1604 comprises a height of the opening 1610 of the second canister 1650 when operably disposed on the platform 1604. In some implementations, the first height and second height above the platform 1604 can comprise the same distance down from the light array 208, 1608. For example, in these implementations, the platform 206, 1606 may be adjusted (e.g., raised or lowered) to dispose the opening 210, 1610 at a distance from the light array 208, 1608 where the light pattern 206, 1606 (e.g., second light pattern) is appropriately focused. In other implementations, the light array 208, 1608 (e.g., and the dispensing head 202, 1602) may be adjusted (e.g., up or down) to appropriately focus the light pattern 206, 1606 at the desired height.

As illustrated in FIGS. 5-11, the light array 508, 1108 can comprise one or more of: a lens assembly 512, 912, 1012, 1112, comprising one or more lenses 514, 914, 1014, 1114; a light source 616, 716, 1116, comprising one more lights 618, 718, 1118; and a light stop 620, 1120, comprising one or more light openings 622, 1122. As illustrated in the light array 508, 1108, the light source 616, 716, 1116 is arranged such that light emitted by the one more lights 618, 718, 1118 is directed downward, such as toward the platform. Further, the light is directed toward the lens assembly 512, 912, 1012, 1112, where the one or more lenses 514, 914, 1014, 1114 arrange the emitted light to a desired focal point below the light array 508, 1108 (e.g., at the first or second height).

In some implementations, the lens assembly 512, 912, 1012, 1112 can comprise a separate lens 514, 914, 1014, 1114 for each of the one more lights 618, 718, 1118. In this implementation, the light from each light is arranged by an accompanying lens. In other implementations, the light array 508, 1108 may comprise fewer lights than lenses, or fewer lenses than lights. For example, the number and arrangement of lights and lenses in the light array 508, 1108 may be dictated by the desired light pattern produced by the light array 508, 1108. As an example, the light source 616, 716, 1116 can produce a desired amount of light (e.g., brightness or illumination), and the lens assembly 512, 912, 1012, 1112 can be configured to produce a desired light pattern based on the amount of light produced by the light source 616, 716, 1116. For example, a lens assembly can be configured to project an arc or circle of unbroken light, an arc or circle of dashed light, or an arc or circle of dots of light.

Additionally, in some implementations, the light array 508, 1108 can comprise the light stop 620, 1120, comprising one or more light openings 622, 1122. The light stop 620, 1120 can be used to direct the light emitted by the one more lights 618, 718, 1118 to the lens assembly 512, 912, 1012, 1112, in order to produce the desired light pattern. That is, for example, the light stop 620, 1120 can be used in conjunction with the light source 616, 716, 1116 and the lens assembly 512, 912, 1012, 1112 to produce a desired shape, size, and focal length of the light pattern. As an example, the light stop can comprise a plurality of openings arranged in a pattern that helps direct the emitted light to lens array 508, 1108 to produce the desired light pattern.

In one implementation, as illustrated in FIGS. 5-11, the light array 508, 1108 can comprise a short optic array. A short-optic array can comprise a relatively short distance between the light source 616, 716, 1116 and the lens assembly 512, 912, 1012, 1112. In this implementation, the resulting light pattern generated by a short optic light array 508, 1108 may comprise larger (e.g., and less bright) dots of light (e.g., or dashed lines of lights, or arc/circle of light). In another implementation, as illustrated in FIGS. 12-15, a light array 1208, 1508 can comprise a long-optic array. A long-optic array can comprise a relatively longer distance between a light source 1316, 1516 and a lens assembly 1312, 1512. In these implementations, the resulting light pattern generated by the long-optic array may comprise smaller (e.g., and brighter) dots of light (e.g., or dashed lines of lights, or arc/circle of light), that appear more focused.

As illustrated in FIGS. 12, 13A, 13B, 14A, 14B, 15A, and 15B, an alternate implementations of a light array 1208, 1508, such as a long-optic light array, can comprise a light source 1316, 1516, comprising one or more lights 1318, 1518; a lens assembly 1312, 1512, comprising one or more lenses 1314, 1514, and can comprise a light stop 1420, 1520, comprising one or more light openings 1422, 1522. In these implementations, the light array 1208, 1508 can be configured to project a light pattern 1206, 1506, such as arranged as an arc of a circle. For example, the resulting light pattern 1206, 1506 can comprise an arc of lighted dots, dashed lines, or a complete line forming the arc of the circle (e.g., that substantially aligns with or inside the opening of the target canister).

As illustrated in FIGS. 5B, 6, 14A, 14B, 15A, and 15B, the dispensing head 502, 1202, 1502 is disposed inside the light array 508, 1208, 1508. The light array 508, 1208, 1508 can be configured to produce the resulting light pattern, such that, when directed downward (e.g., toward the platform), the resulting dispensed colorant will fall within light pattern at the desired height. In this way, for example, the light pattern can be used as a type of target with the corresponding canister (e.g., for the appropriate height), such that the dispensed colorant falls into the opening of the canister.

In some implementations, the light array 108, 308 can comprise a plurality of light emitting diode (LED) lights that are configured to produce the first light pattern 106, 306 (e.g., and second light pattern 206, 1606). Further, in some implementations, the light array 108, 308 can comprise a LED light that is configured to produce the first light pattern 106, 306 in more than one color. That is, for example, LEDs can produce more than one color. In some implementations, the LED can produce different colors that may be indicative of a different state of the dispensing system. For example, during placement of a target canister, the light pattern may comprise a first color, such as red, indicating that the canister is not ready to receive a colorant. Further, for example, once the canister has been appropriately aligned with the light pattern, the LEDs may change to a second color, such as green, indicating that the canister is ready to receive the colorant.

Figure 19:
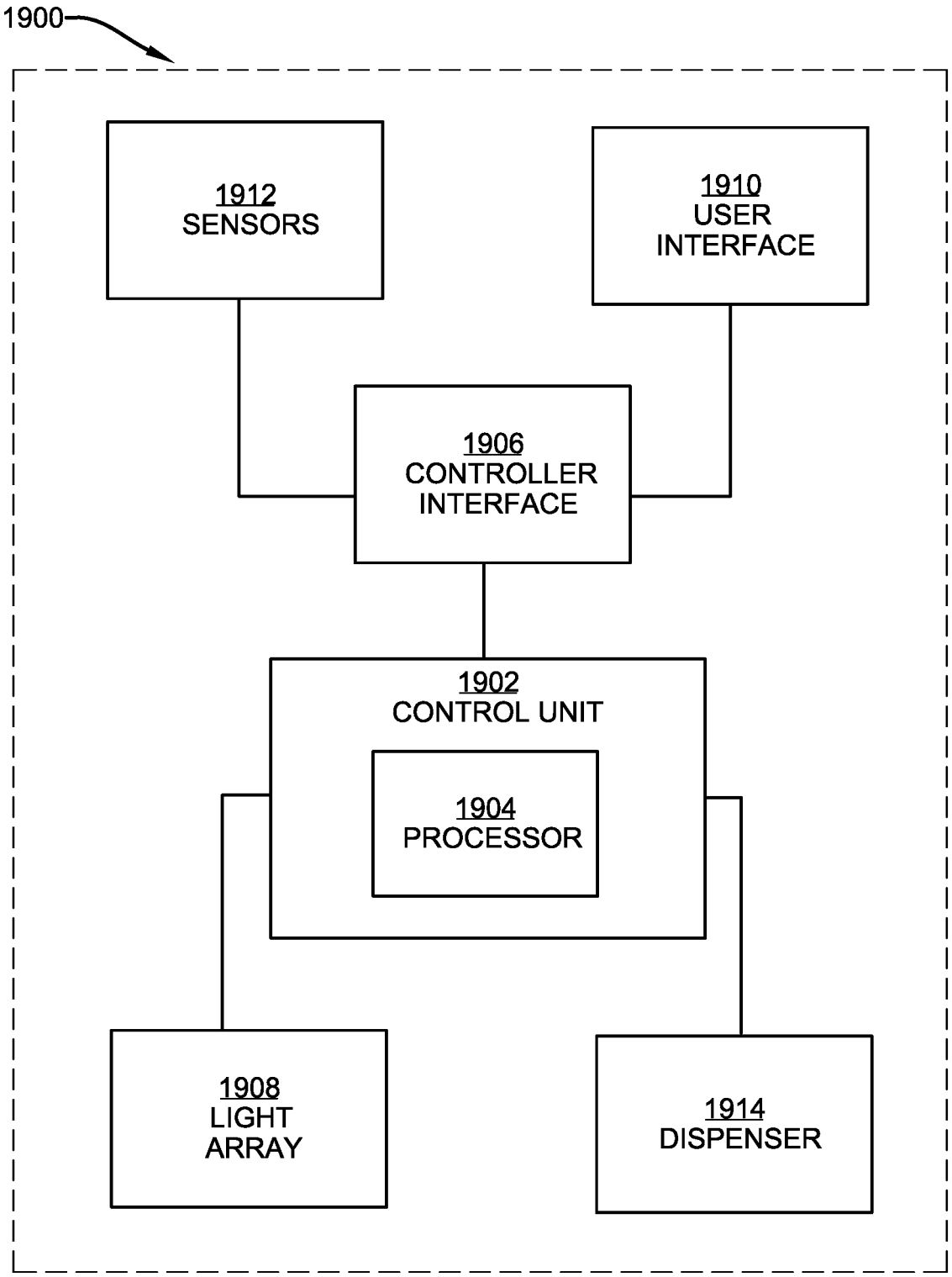
FIG. 19 is a schematic diagram illustrating one implementation of one or more portions of one or more systems described herein.

In some implementations, as illustrated in FIG. 19, an example system 1900 for colorant dispensing can comprise a control unit 1902, comprising a processor 1904. In this example implementation, the control unit 1902 can operably control the light array 1908 based at least upon input from a controller interface 1906. In one implementation, the controller interface 1906 can comprise a user interface 1910 that receives user input, such as from a touch display, keypad, keyboard, mouse, or other input device, which is used by the control unit 1902 to control the light array 1908. For example, a user may enter user input into the user interface 1910 indicative of the type of canister placed on the platform, such as a one-gallon can or a five-gallon bucket (e.g., or some other size). The control unit 1902 may use the data indicative of the user input to direct the light array to produce an appropriate light pattern at an appropriate height for the type of canister, and of an appropriate size for the opening of the canister.

In some implementations, the controller interface 1906 can comprise sensor array 1914 that is configured to detect a position and one or more dimensions of a target canister (e.g., first or second canister) disposed on the platform. That is, for example, input from the sensor array 1914 may be used by the control unit 1902 to control the light array 1908, such as by changing colors, a target height of focus of the light pattern, and/or a size of the circle of the light pattern. For example, a one-gallon can may comprise a first height and a first sized opening. In this example the sensor array 1914 can detect the size and shape, and the data from the sensor array can be used by the control unit 1902 to direct the light array 1908 to produce a light pattern at the height of the can, and of an appropriate size to approximate the opening of the can. Alternately, the sensor array 1914 may detect a five-gallon bucket on the platform, and the light array can be directed to produce a light pattern that is appropriate for the height of the bucket, and size of the opening.

In some implementations, the control unit 1902 can be configured to send a first control signal to the light array 1908 using the controller interface 1906 at a first stage of colorant dispensing, and to send second control signal to the light array 1908 using the controller interface 1906 at a second stage of colorant dispensing. In this implementation, this can result in the light array 1908 being disposed in a first state in response to receipt of the first control signal, and the light array 1908 being disposed in a second state in response to receipt of the second control signals. As an example, the first stage of colorant dispensing can comprise a dispensing stage, and the first state can comprise a first color of the first light pattern. Further, the second stage of the colorant dispensing can comprise a finished dispensing state, and the second state can comprise a second color of the first light pattern.

That is, for example, the light array can change the color of the resulting light pattern depending on the stage of colorant dispensing. There may be two or more colors, in this implementation, such as a first color indicative of pre-dispensing, such as when the canister is being aligned with the light pattern; dispensing, such as during the dispensing of the colorant; and post-dispensing, such as when the colorant dispensing has completed. In this way, in this example, a user may be able to use the visual cues to identify the colorant dispensing states, which can be indicative of desired actions at each state (e.g., placement of canister—pre-dispensing; leave canister in place—dispensing; remove canister—post-dispensing).

As an example, the control unit 1902 may include various components to carry out its functions and operations. For instance, the control unit 1902 may include a control circuits and a processor 1904, which may perform operations of the control unit 1902. The processor 1904 can execute code (e.g., stored in memory (not shown)) to carry out various functions of the colorant dispensing system. Logical functions and/or hardware of the control circuit may be implemented in other manners depending on the nature and configuration of the control unit 1902. Therefore, the illustrated and described approaches are just examples and other approaches may be used including, but not limited to, a control circuit being implemented as, or including, hardware (e.g., a microprocessor, microcontroller, central processing unit (CPU), etc.) or a combination of hardware and software (e.g., a system-on-chip (SoC), an application-specific integrated circuit (ASIC), field programmable gate array (FPGA), etc.).

In one implementation, code executed by the processor 1904 and data stored by the control unit 1902 may be stored by a memory portion (not shown) of the control circuit 1902. The stored data may include, but is not limited to, data associated with the colorant dispensing function of the colorant dispensing system. The memory may be, for example, one or more of a buffer, a flash memory, a hard drive, a removable media, a volatile memory, a non-volatile memory, a random access memory (RAM), or other suitable device. In a typical arrangement, the memory includes a non-volatile (persistent) memory for long term data storage and a volatile memory that functions as system memory for the control unit 1902. The memory is considered a non-transitory computer readable medium.

The control unit 1902 may include a communications interface (not shown) to establish operative communication with external equipment outside the colorant dispensing system. For example, the communications interface may support one or more interface technologies such as, but not limited to, USB, Bluetooth, BLE, WiFi, cellular protocol (e.g., 3G, 4G or 5G), etc.

The control unit 1902 may include an output device (not shown). The output device can output data, for example to a user. The data may be output visually, in which case the output device may be a display. In other embodiments, the data may be output in a transmitted communication signal, in which case the output device is a communication interface such as an NFC chipset, BLE interface, ultrasound or infrared transponder, or other wireless or wired interface, or combined with the communications interface.

As described above, in some implementations, the light may comprise LEDs. As an example, LEDs can be individually controlled to provide light to each "dot" in varying color, brightness, etc., to provide a wide variety of motion effects, flashing, strobing, countdown, and other means of communicating and displaying information, and providing an interesting, pleasing, and useful visual effect. In an example implementation, a control unit, for example, control unit 1902 may send control instructions to the LEDs of a colorant dispensing system to change the color of multi-color LEDs. For example, the multi-color LEDs may display red, yellow, or green light.

In a non-limiting example, the control unit 1902 may send control instructions to the LEDs to display red light when the colorant dispensing system is dispensing (e.g., a "wait" indication). The control unit 1902 may then send control instructions to the LEDs to display green light upon completion of dispensing (e.g., a "ready" indication). Such control offers the advantage of helping to prevent pulling can away before "last drip". The colors can also be any colors apart from those of red and green.

In another example, the LEDs may be single color and the control instructions may send instructions to turn on and off individual LEDs rather than change color.

In a further non-limiting example, while dispensing, the control unit 1902 may send control instructions to the LEDs to change color or turn on/off in a manner consistent with a "countdown timer" (e.g., a shrinking circular "bar-graph"), which allows the operator to anticipate when dispensing is complete, offering a more efficient process (i.e., avoids waiting). In another example, the LEDs may turn on and off in a blinking pattern where the interval between blinks is proportional (or inversely proportional) to the time to completion of dispensing. Pattern for individual LED control instructions may be determined by the control circuit 3100 using data stored in relation to flow rate, container volume, and the like.

Further variations in the control instructions to the LEDs may be: a variation of blink rate, duty cycle variations of blink rate, dimming/brightening of entire ring, blinking when not ready, solid when done, "3-quick blinks" when done, etc. Additional advantages of dynamic, individualized control of the LED's as described above (beyond an increase in information output to an operator of the colorant dispensing system while waiting), is that periodic changing color or turning on and off may reduce the aging of the LEDs.

In another example implementation, dynamic variations in the LEDs of colorant dispensing system may coincide with information displayed on the output device of the control unit 1902. For example, the output device may display to the user that the machine is waiting for information before it can dispense colorant. Simultaneously, the LED lights may be doing a slow and steady blinking pattern (or any of the variations discussed above, as programmed into the processor of the control unit 1902). Such combination of visual indication alerts an operator who may not be aware that further information is required. Such combination of visual information may continue until the required information is entered to the control unit 1902 via user input 1910.

In a further example implementation, coincident output information may be sent from the control unit 1902 to an operator at an external device (e.g., the operator's personal electronic device, for example, a smart phone, or computer, or tablet, or the like) via communications interface 1910 in parallel with the combination of visual indication. Such multi-faceted communication of information may allow for an operator who has stepped away from an individual colorant dispensing unit. For example, an operator who is simultaneously operating multiple colorant dispensing units or other such multi-tasking operation.

Figure 20:
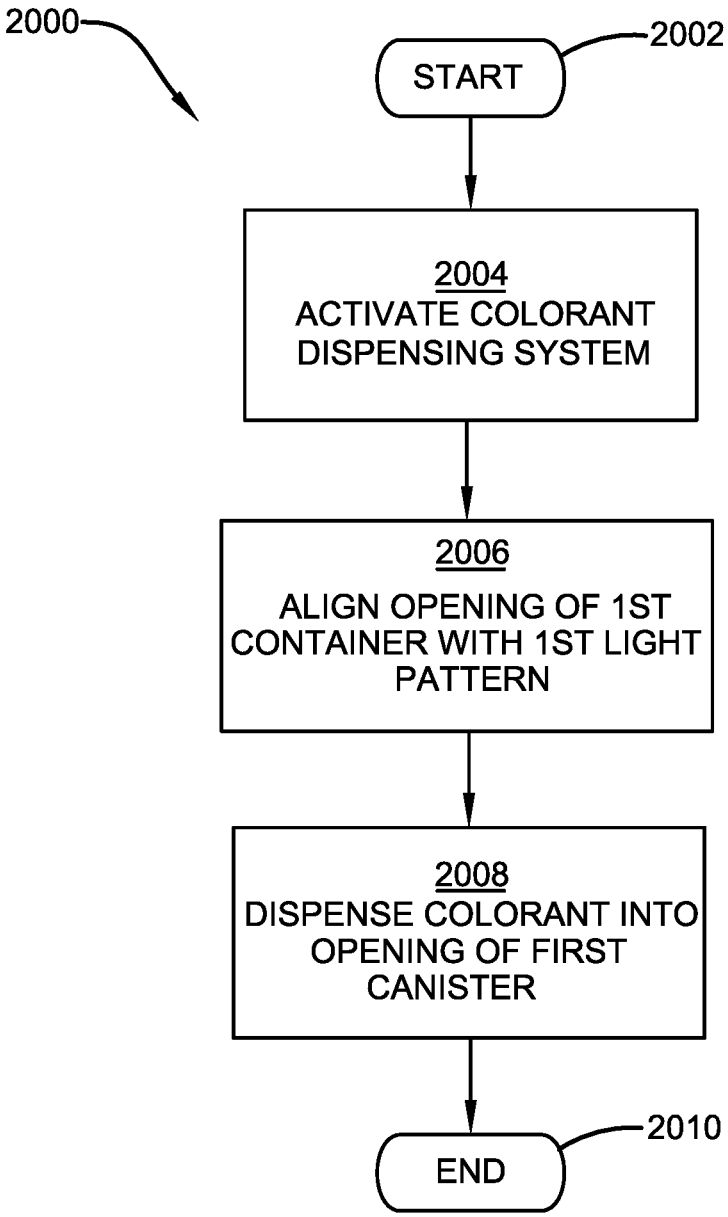
FIG. 20 is a flow diagram illustrating one implementation of method for colorant dispensing.

In one aspect, a method of dispensing a colorant, such as from a colorant dispensing system described herein, may be devised. FIG. 20 is a flow diagram illustrating one exemplary implementation of a method 2000 for dispensing colorant. The exemplary method 2000 begins at 2002. At 2004, a colorant dispensing system is activated. In this implementation, the colorant dispensing system comprises a colorant dispensing head that operably dispenses colorant. Further, the colorant dispensing system comprises a platform that operably holds a first canister into which the colorant is dispensed. The platform is disposed beneath the dispensing head. Additionally, the colorant dispensing system comprises a light array that is disposed above the platform. The light array is operably projecting a first light pattern at a first height above the platform. In this implementation, the first light pattern comprises at least an arc of a first circle. The first circle substantially aligns with or inside an opening of the first canister. Also, the first height above the platform comprises a height of the opening of the first container when operably disposed on the platform.

At 2006 of the exemplary method 2000, the opening of the first canister is aligned with the first light pattern, such that the first light pattern is disposed in substantial alignment with or inside the opening. At 2008, the colorant is dispensed into the opening of the first canister. Having dispensed the colorant into the opening of the first canister, the exemplary method 2000 ends at 2010. For example, a canister can be placed on the platform, and the opening of the canister can be aligned with the light pattern projected from above. In this example, once the opening of the canister is appropriately aligned with the light pattern, the dispensing head can dispense colorant into the opening. As an example, once dispensing is complete, the canister can be removed from the platform.

In some implementation, a method for dispensing a colorant can comprise aligning the opening of the first canister with the first light pattern merely when the first light pattern comprises a first color. For example, when the dispensing unit is ready to receive a target canister, the light array may display a first color, such as yellow. This can indicate to a user that a canister can be place, and alignment can be undertaken. In some implementations, dispensing of the colorant into the opening of the first canister can comprise merely dispensing when the first light pattern comprises a second color. That is, for example, once the appropriate alignment has occurred between the opening and the light pattern, the light array may project another color, such as red, indicating that the dispensing can take place and the canister should remain in place.

In some implementations, ending of the dispensing of the colorant into the opening of the first canister may merely occur when the first light pattern comprises a third color. That is, for example, the dispensing unit may cycle through one or more tints that are dispensed into the canister, such as determined by a preprogrammed set of instructions. In this example, once the appropriate amount and type of colorant is dispensed, the program may end, and the light array may display another color, such as green. This may be an indicator to a user that the canister can be removed, for example, which may mitigate removal prior to completion of tinting.

In some implementations, activating the colorant dispenser can comprise activating the light array (e.g., using the control unit, and or controller interface) to operably project a second light pattern at a second height above the platform. In this implementation, the second light pattern can comprise at least an arc of a second circle, where the second circle substantially aligns with or inside an opening of a second canister. That is, for example, a second canister (e.g., five-gallon bucket) can comprise a different size, and have a different sized opening, than that of the first canister (e.g., on-gallon can). In this example, the second circle can be projected to focus at a different height (e.g., higher) from the platform, and project a different sized arc (e.g., smaller) to fit the second canister opening. In some implementations, the height of the platform can be adjusted to accommodate the first or second canisters. For example, the platform can be lowered to accommodate a five-gallon bucket under the dispensing head.

Figure 17A:
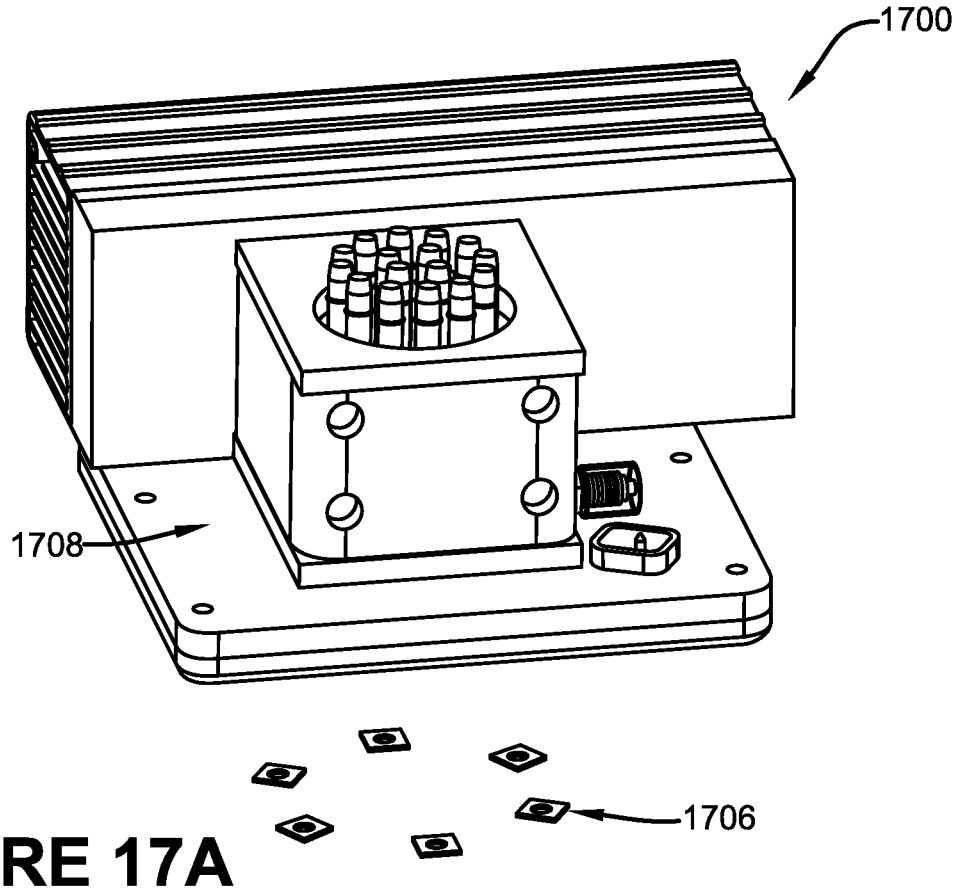
FIGS. 17A and 17B are component diagrams illustrating another alternate implementation of one or more portions of one or more systems described herein.
Figure 17B:
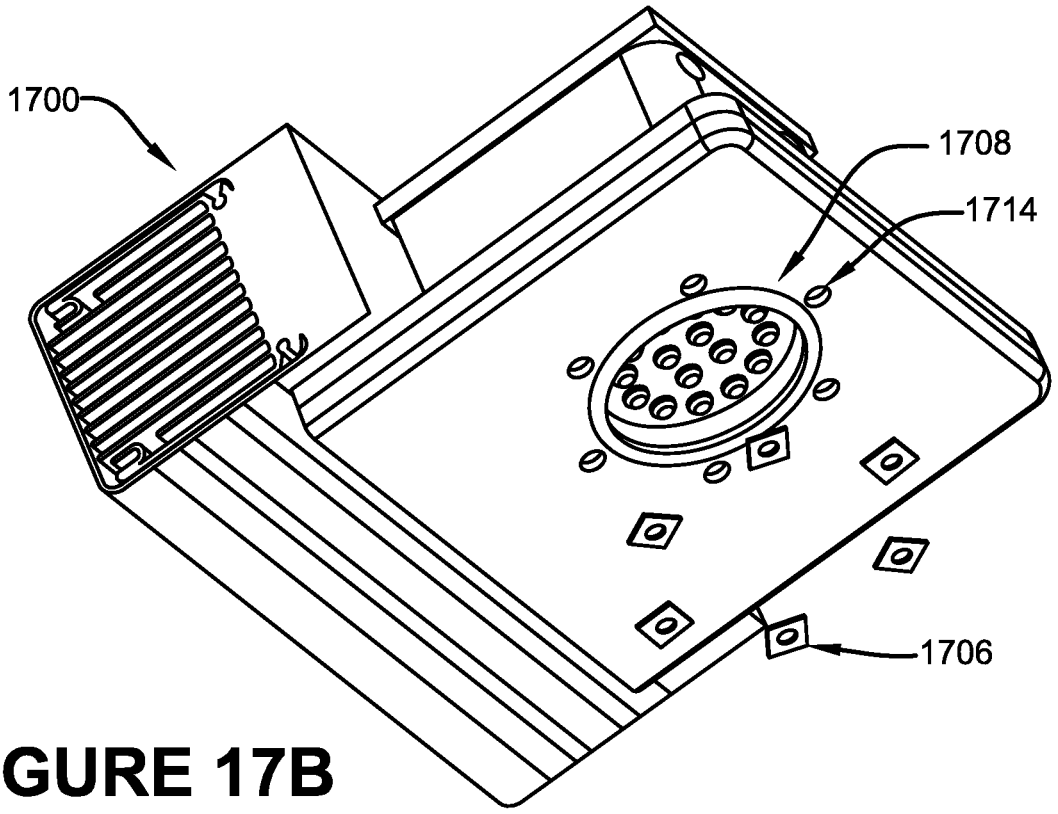

FIGS. 17A and 17B are component diagrams illustrating a top perspective view and a bottom perspective view, respectively, of an implementation of an example portion colorant dispensing system 1700 that utilizes a light array 1708 that uses six LEDs 1714 for to produce an alignment light pattern 1706. In this example implementation, the six LEDs 1714 are arranged in a circular pattern, and are arranged to display a circle of dots in the light pattern 1706. As an example, the LEDs 1714 may be single-color or multi-color LEDs.

Figure 18A:
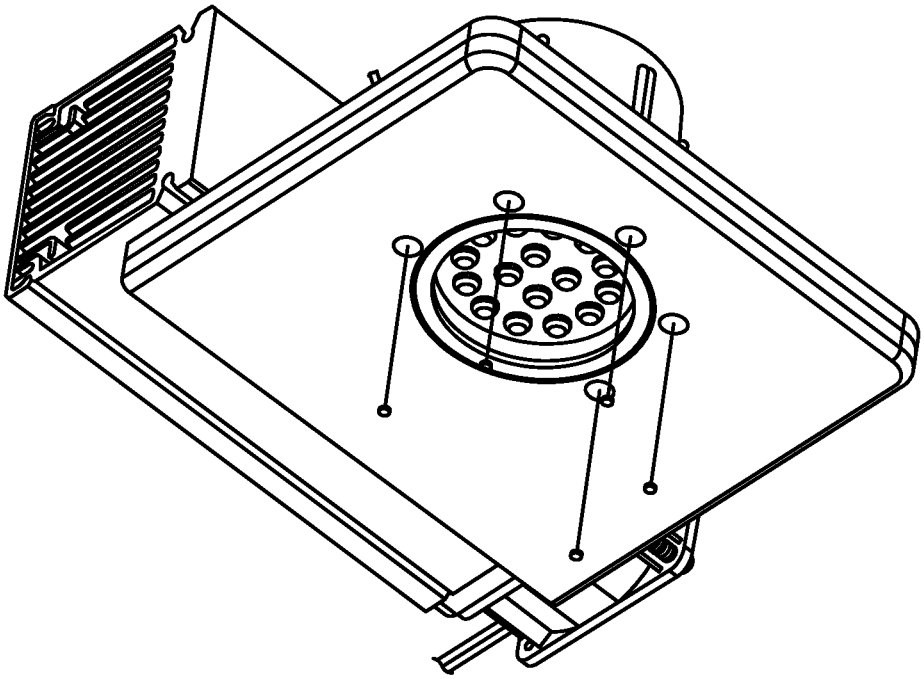
FIGS. 18A and 18B are component diagrams illustrating yet another alternate implementation of one or more portions of one or more systems described herein.
Figure 18B:
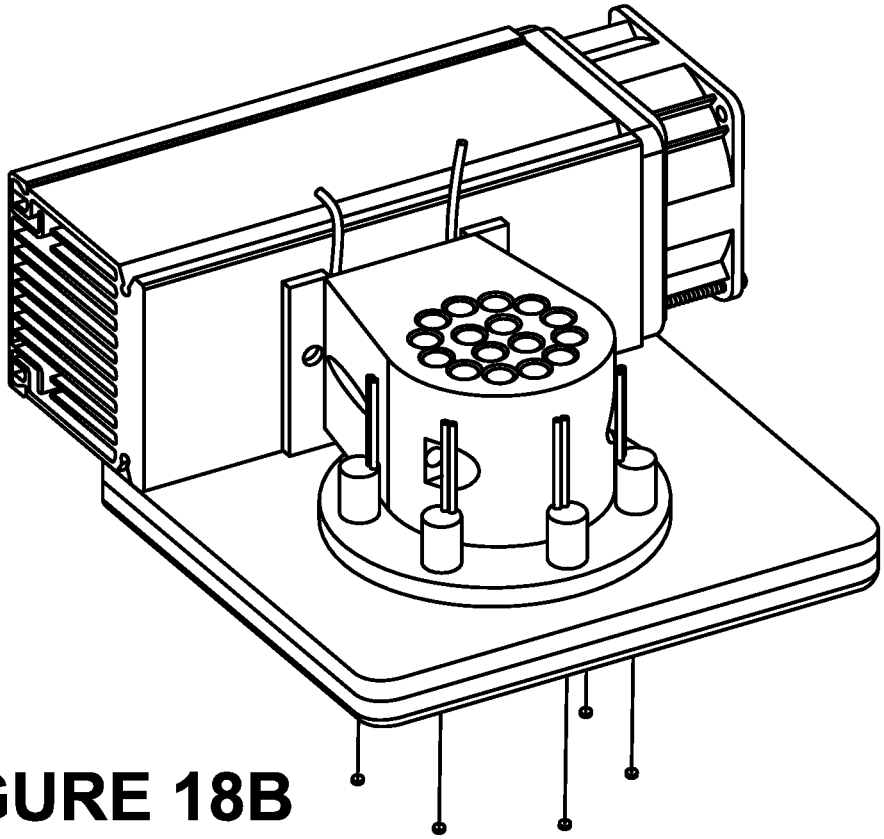

FIGS. 18A and 18B are component diagrams illustrating a bottom perspective view and a top perspective view, respectively, of an implementation of an example colorant dispensing system 1800 that utilizes a light array 1808 comprising dot lasers 1814 to produce an alignment light pattern 1806. In this example implementation, the dot lasers 1814 are arranged in a circular pattern, and are arranged to display a circle of dots in the light pattern 1806. As an example, the dot lasers 1814 may be single-color or multi-color lasers.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, At least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used in this application, the terms "component," "module," "system," "interface," and the like are generally intended to refer to a computer-related entity, either hardware, a combination of hardware and software, software, or software in execution. For example, a component may be, but is not limited to being, a process running on a processor, a processor, an object, an executable, a thread of execution, a program and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable device, carrier or media. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising." Also, with regard to the terms "first," "second," etc. (e.g., "third," "fourth," and so-on), these terms are merely used to designate separate components, steps, systems, techniques, etc. or portions thereof, for the same types. For example, a first widget, a second widget, etc., may identify two separate widgets, even though the widgets may be different, or have the same or similar properties. Further, it should be noted that the use of the terms "first," "second," etc. is not intended to denote a specific order, merely that they are separate things.

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A colorant dispensing system comprising:

a colorant dispensing head that operably dispenses a colorant;

a platform configured to operably hold a first canister into which the colorant is dispensed, the platform disposed beneath the dispensing head; and a light array comprising a plurality of light emitters arranged in an arc-shape on a circuit board disposed above the platform, the light array operably projecting a first light pattern in a shape of an arc of a first circle that is substantially focused at a first height above the platform;

wherein the first light pattern comprises light emitted from the first light array aligned in the arc-shape that comprises the arc of the first circle, wherein the first circle substantially aligns with or inside an opening of the first canister; and wherein the first height above the platform comprises a height of the opening of the first container when operably disposed on the platform.

2. The system of claim 1, comprising a control unit, comprising a processor, the control unit operably controlling the light array based at least upon input from a controller interface.

3. The system of claim 2, the controller interface comprising one or more of:

a user interface configured to receive user input used by the control unit to control the light array; and a sensor array configured to detect a position and one or more dimensions of the canister disposed on the platform.

4. The system of claim 2, the control unit is configured to send a first control signal to the light array using the controller interface at a first stage of colorant dispensing, and to send second control signal to the light array using the controller interface at a second stage of colorant dispensing, resulting in the light array being disposed in a first state in response to receipt of the first control signal, and the light array being disposed in a second state in response to receipt of the second control signals.

5. The system of claim 4, wherein the first stage of colorant dispensing comprises a dispensing stage, and the first state comprises a first color of the first light pattern, and the second stage of the colorant dispensing comprise a post dispensing state, and the second state comprises a second color of the first light pattern.

6. The system of claim 1, the light array operable to project a second light pattern at a second height above the platform, wherein the second light pattern comprises at least an arc of a second circle, wherein the second circle substantially aligns with an opening of a second canister.

7. The system of claim 6, wherein the second height above the platform comprises a height of the opening of the second canister when operably disposed on the platform.

8. The system of claim 7, wherein the first height and second height above the platform comprise the same distance down from the light array.

9. The system of claim 1, the light array comprising a plurality of light emitting diode (LED) lights configured to produce the first light pattern.

10. The system of claim 1, the light array comprising a LED light configured to produce the first light pattern in more than one color.

11. The system of claim 1, the first light pattern comprising a plurality of lighted dots aligned to form the arc of the first circle.

12. The system of claim 1, the light array comprising a lens assembly configured to focus light produced by the light array to the first height.

13. The system of claim 1, the light array comprising a lens assembly configured to arrange light produced by the light array into the first pattern.

14. A colorant dispensing device that comprises a dispensing head to dispense colorant, a platform to operably hold a canister beneath the dispensing head to operably receive the dispensed colorant, the device comprising:

a light array comprising a plurality of light emitters arranged in an arc-shape disposed above the platform, the light array operably projecting a light pattern at an opening of the canister operably disposed on the platform, the light pattern comprising a shape of a circle, wherein the circle substantially aligns with or inside an opening of the canister, the light array comprising:

a plurality of light emitting diode (LED) lights arranged in a circle pattern on a circuit board and configured to emit light in the circle pattern; and a lens array configured to receive the light emitted from the LED lights and direct the emitted light into the light pattern substantially focused at the opening of the canister; and a control unit comprising a processor to operably control the dispensing device, wherein the control unit operably controls the light array based at least upon input from a controller interface that operably receives user input to control the light array, the control unit configured to send a first control signal to the light array at a first stage of colorant dispensing, and to send second control signal to the light array at a second stage of colorant dispensing, resulting in the light array being disposed in a first state in response to receipt of the first control signal, and the light array being disposed in a second state in response to receipt of the second control signals.

* * * * *